US005841460A

United States Patent [19]

Maslanka et al.

[11] Patent Number: 5,841,460

[45] Date of Patent: Nov. 24, 1998

[54] THERMAL PRINTER WHICH RECIRCULATES RECEIVER SHEET BETWEEN SUCCESSIVE PRINTING PASSES

[75] Inventors: Daniel Charles Maslanka; Terrence Lee Fisher; Vlade Josif Kordovich, all of Rochester, N.Y.

[73] Assignee: Eastman Kodak Company, Rochester, N.Y.

[21] Appl. No.: 641,250

[22] Filed: Apr. 30, 1996

[51] Int. Cl.[6] ..... B41J 13/00

[52] U.S. Cl. ..... 347/176; 347/218

[58] Field of Search ..... 347/218, 172, 347/174, 176; 400/120.02, 120.04; 346/138

[56] References Cited

U.S. PATENT DOCUMENTS

| | | | |
|---|---|---|---|
| 4,013,159 | 3/1977 | Okabe | 197/1 R |
| 4,710,041 | 12/1987 | Shimada et al. | 347/176 |
| 4,733,250 | 3/1988 | Nozaki et al. . | |
| 4,751,519 | 6/1988 | Shimada et al. | 347/176 |
| 4,990,933 | 2/1991 | Hatakeyama | 347/174 |
| 5,110,227 | 5/1992 | Hatakeyama | 400/593 |
| 5,176,459 | 1/1993 | Bessho et al. . | |
| 5,280,303 | 1/1994 | Maslanka . | |
| 5,304,007 | 4/1994 | Flanagan . | |
| 5,378,071 | 1/1995 | Uehara . | |
| 5,380,394 | 1/1995 | Shibuya et al. . | |

FOREIGN PATENT DOCUMENTS

| | | | |
|---|---|---|---|
| 0 159 673 | 10/1985 | European Pat. Off. . | |
| 7-061067 | 3/1995 | Japan | B41J 11/04 |
| 7-061075 | 3/1995 | Japan | B41J 13/02 |
| 7-061076 | 3/1995 | Japan | B41J 13/10 |
| 7-076142 | 3/1995 | Japan | B41J 13/02 |
| 8-11374 | 1/1996 | Japan | B41J 13/00 |
| 2 182 610 | 5/1987 | United Kingdom . | |
| 2 202 492 | 9/1988 | United Kingdom . | |
| 2289444 | 11/1995 | United Kingdom . | |

*Primary Examiner*—Huan H. Tran
*Attorney, Agent, or Firm*—Gordon M. Stewart; Charles E. Snee, III

[57] ABSTRACT

A thermal printer (10) is useful for printing onto a receiver sheet (22, 24, 26) having a leading edge and a trailing edge and includes an elongated rotatable platen (34); an elongated thermal print head (30) positioned parallel to the platen; a closed loop pathway (12, 14, 16) for recirculating the receiver sheet in a printing direction from the platen and back to the platen, the platen being positioned for rotation in the printing direction with at least a portion of the platen in the pathway to engage the receiver sheet or a dye donor web (31); a supply roll (28) of dye donor web positioned upstream of the print head; a mechanism (76–112, 132–142) for moving the print head into the pathway opposite the platen to press the print head into engagement with the dye donor web, the dye donor web into engagement with the receiver sheet, and the receiver sheet into engagement with the platen; a mechanism (180–188) for rotating the platen in the printing direction to move either the dye donor web or both the dye donor web and the receiver sheet between the print head and the platen; and a mechanism (18, 166–174) for recirculating the receiver sheet through the closed loop pathway in the printing direction for successive thermal transfers of different dyes from the dye donor web. A method of thermal printing also is taught.

48 Claims, 18 Drawing Sheets

THERMAL PRINTER WHICH RECIRCULATES RECEIVER SHEET BETWEEN SUCCESSIVE PRINTING PASSES

CROSS-REFERENCE TO RELATED APPLICATIONS

This application is related to commonly assigned, concurrently filed U.S. patent applications Ser. No. 8/641323 for Thermal Printer with Improved Print Head Assembly; Ser. No. 8/641128 for Thermal Printer Which Uses Platen to Transport Dye Donor Web Between Successive Printing Passes; and Ser. No. 3/641127 for Thermal Printer with Sensor for Leading Edge of Receiver Sheet.

TECHNICAL FIELD

The invention concerns thermal printers in which a print head engages and selectively heats a dye donor web to cause dye transfer to a receiver sheet. More particularly, the invention relates to a printer in which the receiver sheet is recirculated in a direction of printing between printing passes.

BACKGROUND OF THE INVENTION

In a thermal printer, making a print involves a sequential execution of a variety of mechanical and electromechanical actions. For example, a sheet of dye receiver, or receiver sheet, must be loaded into the printer and accurately positioned in a print zone. A dye donor web must be accurately positioned in the print zone in register with the receiver sheet. A print head must be moved to form a printing nip with a rotatable platen, the receiver sheet and the dye donor web being captured between the print head and the platen. The receiver sheet and the dye donor web must be transported precisely through the printing nip. Depending on the number of colors to be combined in a completed print, the foregoing actions must be repeated. Finally, when a print has been completed on the receiver sheet, the print must be ejected from the printer.

This mode of thermal printing may vary slightly among printer designs but every printer must have both mechanisms and a properly programmed controller to execute its particular printing cycle. Since the cost of the mechanisms is high in comparison to the cost of software for the controller, controlling a manufacturer's costs for a printer essentially requires minimization of the amount of mechanical and electromechanical hardware in the printer. In spite of this incentive for simplification of printer design, most commercially available thermal printers use a first, dedicated electromechanical system to transport the receiver sheet through the printing nip and a second, dedicated electromechanical system to transport the dye donor web through the printing nip.

As shown in commonly assigned U.S. Pat. No. 5,280,303, the receiver sheet commonly may be metered by clamping it to a large print drum. Alternatively, the receiver sheet may be transported by pinch rollers which pull it through the printing nip. The donor usually is collected on a take-up spool which is driven through a slip clutch by a separate motor and drive train. In the printer of the commonly assigned patent, a capstan downstream of the print head and platen helps to maintain minimal tension on the donor web during printing and also meters the donor web between printing passes. Thus, a need has existed for a simplified thermal printer in which the number and complexity of mechanical and electromechanical systems has been reduced, to provide a product more readily affordable by a larger number of customers.

In thermal printers of the type just described, the receiver sheet has been transported either by clamping it to a large print drum and rotating the print drum in a single print direction to present the receiver sheet repeatedly for transfer of each successive dye; or by advancing the receiver sheet past the print head in a print direction for a transfer of a first dye, reversing the direction of movement of the receiver sheet to position it for transfer of a second dye, and then advancing the receiver sheet in the print direction for transfer of the second dye. A need has existed for a printer in which a receiver sheet could be recirculated in a closed loop in the print direction between printing passes, thus eliminating any need for a large print drum or for reversing the direction of movement of the receiver sheet after each printing pass.

SUMMARY OF THE INVENTION

The primary objective of the invention is to provide a simpler, less costly thermal printer.

A further objective of the invention is to provide such a printer in which photographic quality prints can be produced even though the apparatus has been simplified and made less costly.

Another objective of the invention is to provide an improved thermal printer in which a receiver sheet is recirculated in a closed loop in a print direction, to simplify the structure and operation of the printer.

These objectives are given only by way of illustrative examples; thus other desirable objectives and advantages inherently achieved by the disclosed invention may occur or become apparent to those skilled in the art. Nonetheless, the scope of the invention is to be limited only by the appended claims.

A thermal printer in accordance with the invention is useful for printing onto a receiver sheet having a leading edge and a trailing edge. The printer may include an elongated rotatable platen; an elongated thermal print head positioned parallel to the platen; a closed loop pathway for recirculating a receiver sheet in a printing direction from the platen and back to the platen, the platen being positioned for rotation in the printing direction with at least a portion of the platen in the pathway to engage a receiver sheet or a dye donor web; a supply roll of dye donor web positioned upstream of the print head; means for moving the print head into the pathway opposite the platen to press the print head into engagement with the dye donor web, the dye donor web into engagement with the receiver sheet, and the receiver sheet into engagement with the platen, with sufficient force (a) upon operation of the print head for thermal transfer of dye to the receiver sheet and (b) upon rotation of the platen in the printing direction for transport of either the dye donor web or both the dye donor web and the receiver sheet between the print head and the platen; means for rotating the platen in the printing direction to move either the dye donor web or both the dye donor web and the receiver sheet between the print head and the platen; and means for recirculating the receiver sheet through the closed loop pathway in the printing direction for successive thermal transfers of different dyes from the dye donor web.

The means for recirculating may include roller means extended into the pathway for urging the receiver sheet through the closed loop pathway in the printing direction; means for sensing when the leading edge of the receiver sheet has passed between the platen and the dye donor web and for producing a signal; and means, responsive to the signal, for disengaging the roller means from the receiver sheet before printing commences. The means for rotating the platen also may rotate the roller means on a shaft; and the means for disengaging the roller means may include a cam; a cam follower engaging the cam and the shaft; and means for moving the cam to move the follower and the shaft, there by moving the roller means into or out of engagement with the receiver sheet. The means for rotating may include a first pulley mounted for rotation with the platen; a second pulley mounted for rotation with the shaft and the roller means; and a resilient drive belt engaged with the first and second pulleys to transmit rotation to the roller means and to maintain engagement between the cam and the cam follower. In one embodiment, the platen may include a shaft with an end portion; the cam may include a plate cam mounted for rotation around the end portion; and the means for moving may rotate the cam. The roller means may be mounted on a shaft, the shaft being set at an acute angle to a direction of movement of the receiver sheet through the pathway.

Means may be included for sensing when the leading edge of the receiver sheet has reached a predetermined location downstream of the print head and for producing a further signal; and means, responsive to the further signal, for activating the print head to cause dye transfer between the dye donor web and the receiver sheet. The means for sensing and producing a further signal may include a pivoted sensor lever having a free end positioned downstream of the print head to be engaged by the leading edge; and means for detecting movement of the sensor lever upon moving contact between the free end and the leading edge.

The printer may include a take-up roll positioned downstream of the printer head to receive dye donor web after passage thereof between the print head and the platen. The means for rotating the platen also may rotate the take-up roll and may include a platen drive member fixedly mounted on a shaft of the platen; a take-up drive member rotatably mounted on the shaft of the platen; slip clutch means for causing the take-up drive member to rotate with the shaft of the platen; and means for transmitting rotation of the take-up drive member to the take-up roll. Means may be provided for preventing reverse rotation of the take-up roll.

The means for moving the print head may include means for supporting the print head adjacent the platen; an elongated beam spring having opposite ends; a fulcrum member extended from the means for supporting to engage the beam spring between the opposite ends; and means for engaging the beam spring at the opposite ends to deflect the beam spring and thereby press the print head into engagement. The means for engaging may include a pair of movable cams, each cam having a respective slot of decreasing radius from an axis of rotation of the platen, each slot being engaged with one of the opposite ends; and means for moving the cams to cause the print head to be pressed into engagement with the dye donor web. Each slot may open to a periphery of a respective cam, to permit the print head, fulcrum member and beam spring to be disengaged from the cams. The cams may be rotatable, each cam having a respective slot of decreasing radius from an axis of rotation of the cam, each slot being engaged with one of the opposite ends; and the printer may include means for rotating the cams to cause the print head to be pressed into engagement with the dye donor web. The plate cams may be mounted for rotation about a respective one of the shaft ends of the platen.

The means for rotating the platen also may rotate the roller means on a shaft; and the means for disengaging the roller means may include a radially projecting lobe on one of the rotatable cams; and a cam follower engaging the lobe and the shaft, whereby rotation of the one cam moves the follower and the shaft, thereby moving the roller means into or out of engagement with the receiver sheet.

The method of the invention is useful for thermal printing onto a receiver sheet using a dye donor web comprising successive color groups of patches of different dyes. The method may include steps of: (a) engaging an elongated thermal print head with one side of the dye donor web, an opposite side of the dye donor web with one side of the receiver sheet, and an opposite side of the receiver sheet with a rotatable platen; (b) rotating the platen in a printing direction to advance both the dye donor web and the receiver sheet; (c) simultaneously with step (b) operating the print head to transfer to the receiver sheet a dye of a first color of a color group; (d) following transfer of the dye of the first color, continuing rotation of the platen in the printing direction to advance the receiver sheet from between the platen and the dye donor web; (e) continuing rotation of the platen in the printing direction to advance the dye donor web a predetermined distance and thereby locate downstream of the printhead a beginning of a next color of the color group and then stopping rotation of the platen; (f) disengaging the print head from the dye donor web; (g) recirculating the receiver sheet in the printing direction and reintroducing the receiver sheet between the dye donor web and the platen; (h) reengaging the print head with the dye donor web; (i) again rotating the platen in the printing direction to advance both the dye donor web and the receiver sheet; and (j) simultaneously with step (i) operating the print head to transfer to the sheet a dye of the next color of the color group. The method also may include a step of (k) repeating steps (d) to (j) for successive colors of the color group to complete printing to the receiver sheet.

The invention provides various advantages. The printer is simpler and less costly than known thermal printers. The use of a closed loop pathway for recirculating the receiver sheet locates the leading edge of the receiver sheet near the position required for printing, thus providing a printing cycle time nearly the same as that of printers using large printing drums with dedicated clamping mechanisms for the receiver sheet. Since a large printing drum is not needed, a small diameter platen can be used, which permits use of less expensive, commercially available print heads which are not suited for use with large printing drums that normally require custom print heads to accommodate their large diameters. The receiver sheet is accurately repositioned for each printing pass.

BRIEF DESCRIPTION OF THE DRAWINGS

The foregoing and other objectives, features and advantages of the invention will be apparent from the following more particular description of the preferred embodiments of the invention, as illustrated in the accompanying drawings.

DESCRIPTION OF THE PREFERRED EMBODIMENTS

Figure 1:
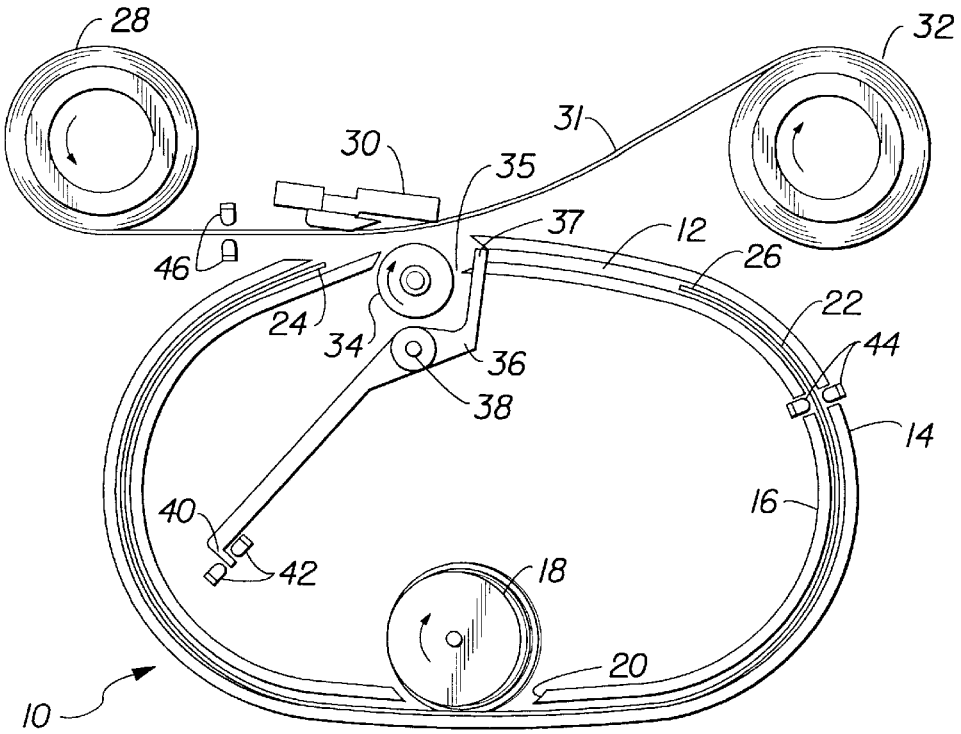
FIGS. 1 to 6 schematically illustrate a thermal printer in accordance with the invention, in successive stages of a printing cycle.
Figure 2:
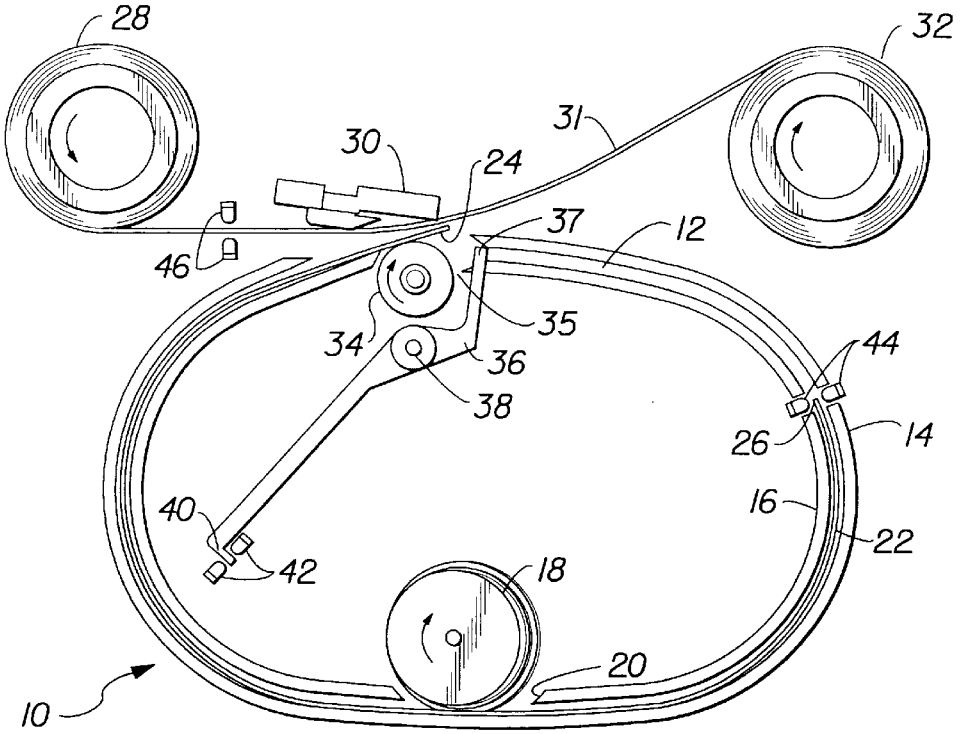

The following is a detailed description of the preferred embodiments of the invention, reference being made to the drawings in which the same reference numerals identify the same elements of structure in each of the several Figures.

Overall Structure and Operation

Referring to FIGS. 1 to 6 and the following description, those skilled in the thermal printer art will understand the overall structure and operation of a thermal printer apparatus 10 in accordance with the invention. A closed loop pathway 12 is defined between an outer guide wall 14 and an inner guide wall 16. The skilled person will appreciate that two pairs of such guide walls, only one being illustrated in FIGS. 1 to 6, would be provided to define pathways at least for two opposite edges of a receiver sheet web to be moved through the printer. Of course, those skilled in the art will understand that pathway 12 may extend across the width of the receiver sheet to provide better support and guidance for the receiver sheet.

A rotatable urge roller 18 extends through an opening 20 in guide wall 16 to engage one of the opposite edges of a receiver sheet 22, the receiver sheet having a leading edge 24 and a trailing edge 26. As will be explained in detail later in this description, urge roller 18 can be moved into engagement with receiver sheet 22 to position the receiver sheet for printing or to eject it after printing, and out of engagement with the receiver sheet during a printing pass. A resilient pad of smooth-surfaced material such as a strip of Teflon tape or a piece of plush velvet, not illustrated, may be provided on guide wall 14 beneath urge roller 18, to minimize abrasion of the print side of receiver sheet 22. Upon rotation of the urge roller when it is engaged with receiver sheet 22, the receiver sheet can be driven along pathway 22 in a clockwise direction, as illustrated.

Outside pathway 12, a roll 28 of conventional dye donor web is supported for counter-clockwise rotation upstream of a conventional thermal print head 30. A web 31 of dye donor extends from roll 28 beneath print head 30 and on to a dye donor take-up roll 32 positioned downstream of the print head. Below the print head, a rotatable platen roller 34 extends through an opening 35 in guide wall 16. Preferably, platen 34 includes a rigid central shaft and a resilient outer layer. Depending on the time of the printing cycle, platen 34 may engage either dye donor web 31 or receiver sheet 22. To facilitate movement of the donor web and receiver sheet through the nip between print head 30 and platen 34 without slipping of the receiver sheet on the platen or sticking of the donor web to the print head, the coefficient of friction between the platen and the receiver sheet should be greater than that between the donor web and the print head; and the coefficient of friction between the receiver sheet and the donor web also should be greater than that between the donor web and the print head.

A leading edge sensor lever 36 is mounted on a pivot 38 and includes a contact end 37 which can extend into pathway 12 to encounter leading edge 24. At an opposite end of lever 36, a circumferentially extended sensor flag 40 is provided for interaction with a conventional optical sensor 42 of a type comprising a light source and detector pair. Upstream of print head 30, an optical sensor 46, similar in general type to sensor 42, is provided to sense a transition from a final cyan dye patch of a previous color group of dye patches on web 31 to an initial yellow dye patch of a current color group. Those skilled in the art will understand that the light source of sensor 46 should be red which can be blocked by a cyan dye patch; whereas, the sources of sensors 42 and 44 can be practically any low cost source.

In accordance with the invention, the printer apparatus of FIGS. 1 to 6, and also that of FIGS. 7 to 30, operates in essentially the following manner, under the guidance of a conventional programmable controller, not illustrated. When the printer first is turned on, urge roller 18 is rotated counter-clockwise, to eject any receiver sheet which may happen to be present, through an insertion/ejection port in guide wall 14 upstream of sensor 44, not illustrated in FIGS.

1 to 6. Then, head 30 is raised above platen 34 and urge roller 18 is raised above guide wall 14. When a fresh receiver sheet is inserted into pathway 12 through the insertion/ejection port, its presence is detected by sensor 44. Print head 30 then is preheated. To position dye donor web 31, print head 30 is then lowered until the dye donor web is pressed in a nip between the print head and platen 34. Urge roller 18 remains in its raised position. An output from sensor 46 indicates whether or not a cyan dye patch of a previous color group is present at the sensor. If a cyan patch is present, platen 34 is rotated clockwise to advance the dye donor web until the cyan patch has passed the sensor, indicating a transition to a current group of dye patches. The platen then is rotated an additional predetermined amount to position a leading edge of the yellow patch of the current color group just past the nip between the print head and the platen.

Figure 3:
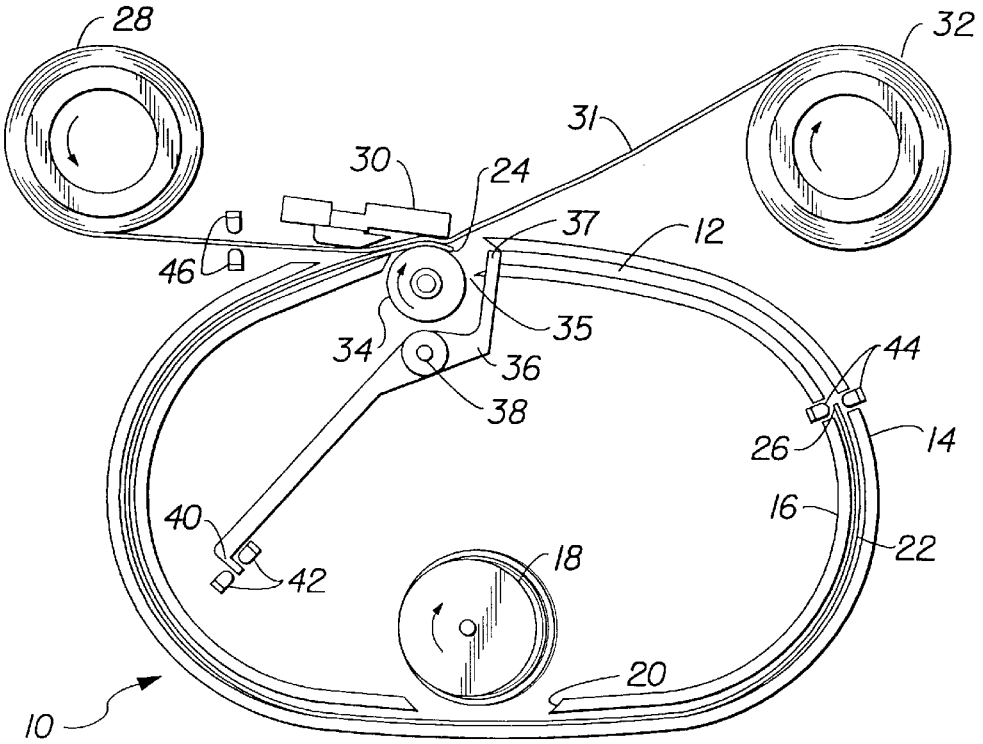
Figure 4:
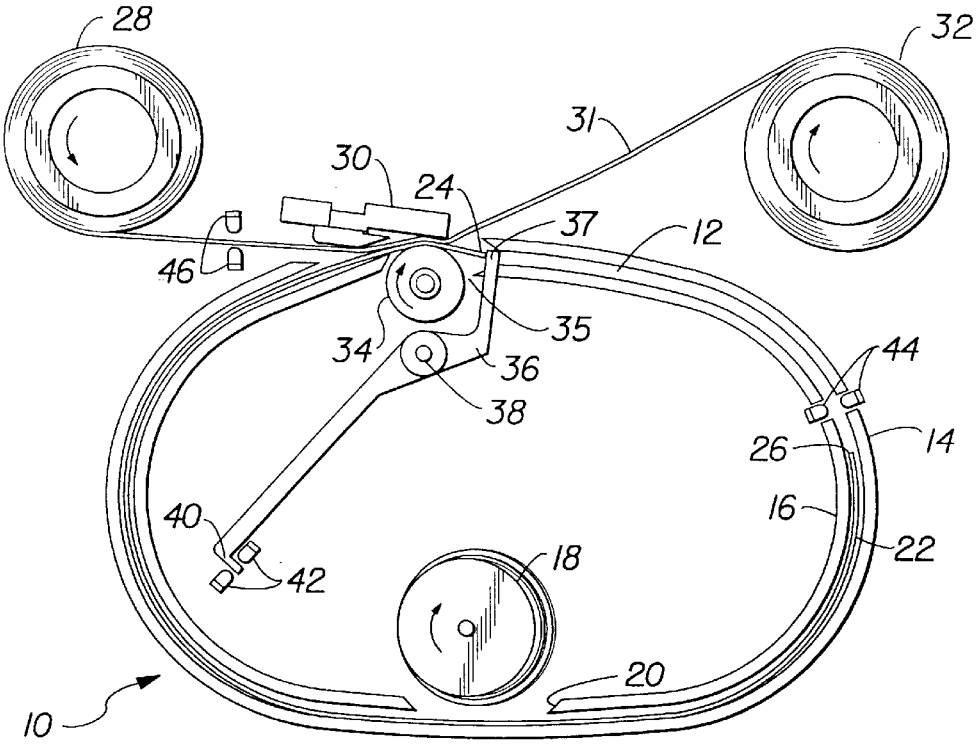

The print head is then raised above the platen to the position of FIG. 1. The urge roller is lowered into contact with the receiver sheet and rotated clockwise until sensor 44 detects the passage of trailing edge 26, at which point leading edge 24 has moved to the position of FIG. 2. The urge roller then is raised out of contact with the receiver sheet, stopping its movement through pathway 12. The print head then is lowered to press the dye donor web and the receiver sheet in a nip between the print head and the platen, as shown in FIG. 3. The platen is then rotated clockwise to move both the dye donor web and the receiver sheet until leading edge 24 encounters contact end 37 of sensor lever 36, as shown in FIG. 4, and causes the sensor lever to pivot clockwise until sensor flag 40 clears sensor 42, to indicate that the receiver sheet is in position for printing to commence for the first color patch of the current color group on the dye donor web. Of course, printing also could commence when the platen has rotated a predetermined distance past the point where sensor 42 has cleared. The point at which sensor 42 is cleared provides a precise reference position to which the printer can return in subsequent printing passes to accurately reposition the receiver sheet in registration with the print head for each printing pass. Friction between contact end 37 and the back side of the receiver sheet prevents sensor lever 36 from rotating back to its initial position until the receiver sheet has moved completely past.

Figure 5:
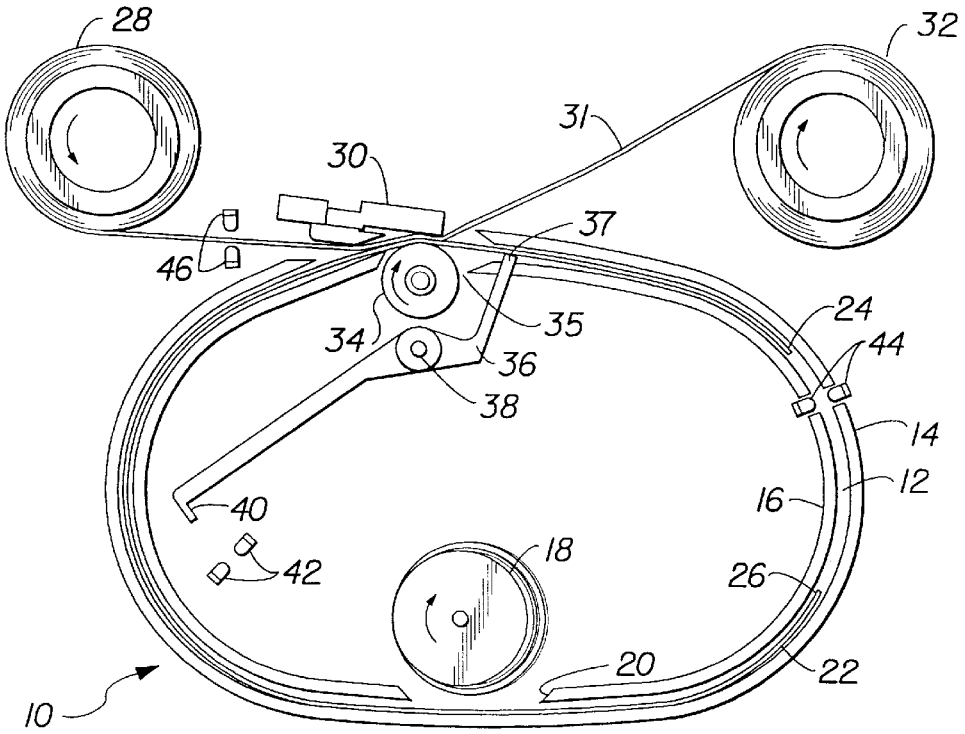
Figure 6:
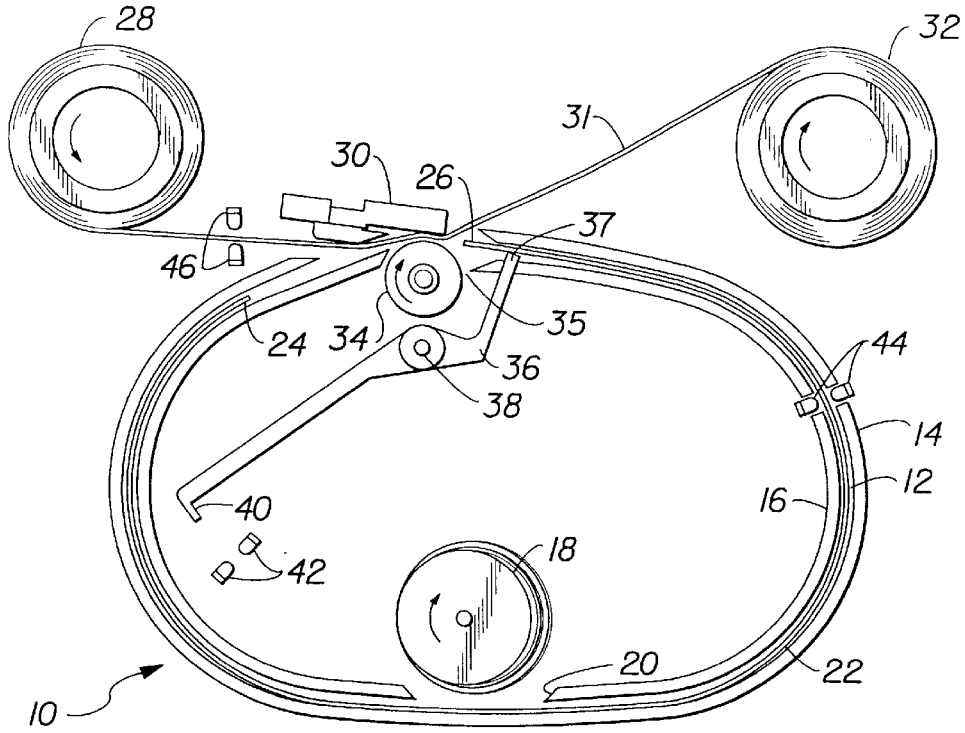

The platen then is rotated and the first printing pass commences. Continued rotation of the platen causes the receiver sheet to slip over contact end 37, as shown in FIG. 5, as printing continues for the yellow color patch. When the first printing pass has been completed, trailing end 26 is pushed out of the nip, leaving only dye donor web 31 pinched between the print head and platen. Sensor lever 36 is released to rotate back to the position of FIG. 1, with sensor 42 again blocked. Platen 34 is then rotated a predetermined distance until the start of the magenta color patch is positioned just past the nip between the print head and the platen, as shown in FIG. 6. This predetermined distance is readily determinable due to the known size of the color patches on the dye donor web. The cycle described in this and the previous paragraph then is repeated until printing has been completed for the magenta and cyan color patches on the dye donor web, to form a full color image. When the final printing pass has been completed, urge roller 18 is engaged with the receiver sheet and rotated counterclockwise to eject the completed print from the apparatus.

Detailed Description

Referring to FIGS. 7 to 30, the structure and operation of an actual embodiment of the invention can be understood by the skilled person. Thermal printer apparatus 10 may be enclosed in a housing comprising a base 60 and a removable cover 62. An access door 64 is provided to close an opening in cover 62 during printing. Typically, door 64 would be opened only to replace the dye donor web. Door 64 is pivoted between a right mechanism support plate 66 and a left mechanism support plate 68, on a tie bar 70 which passes between a pair of support flanges 72, 74 extended upward from the two mechanism support plates. Pivot flanges 73, 75 extend downwardly from the access door and pivotably engage opposite ends of bar 70.

Figure 7:
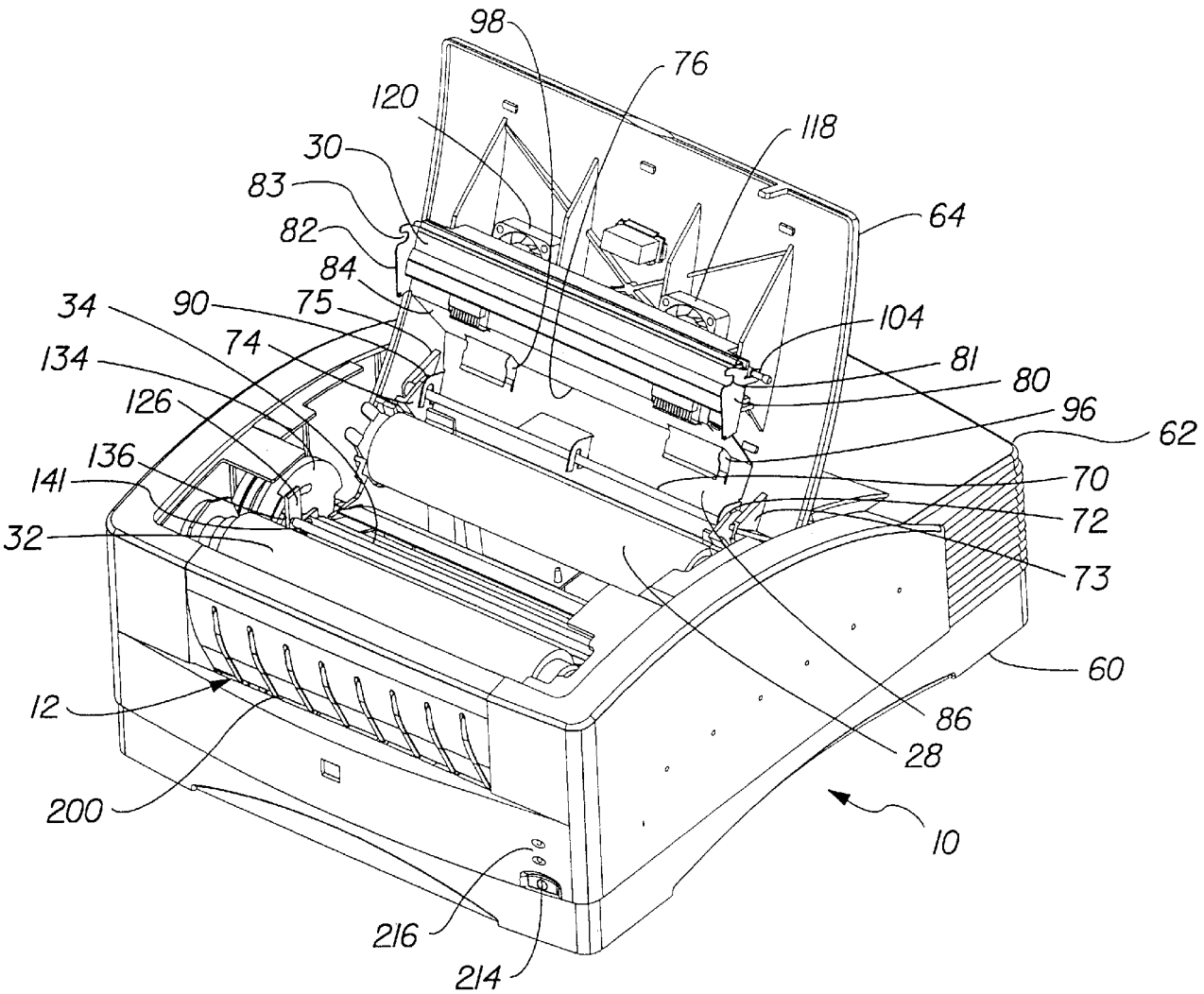
FIG. 7 illustrates a perspective view of a front and a right side of an actual embodiment of a thermal printer in accordance with the invention, in which the access door and thermal print head have been pivoted upward.
Figure 9:
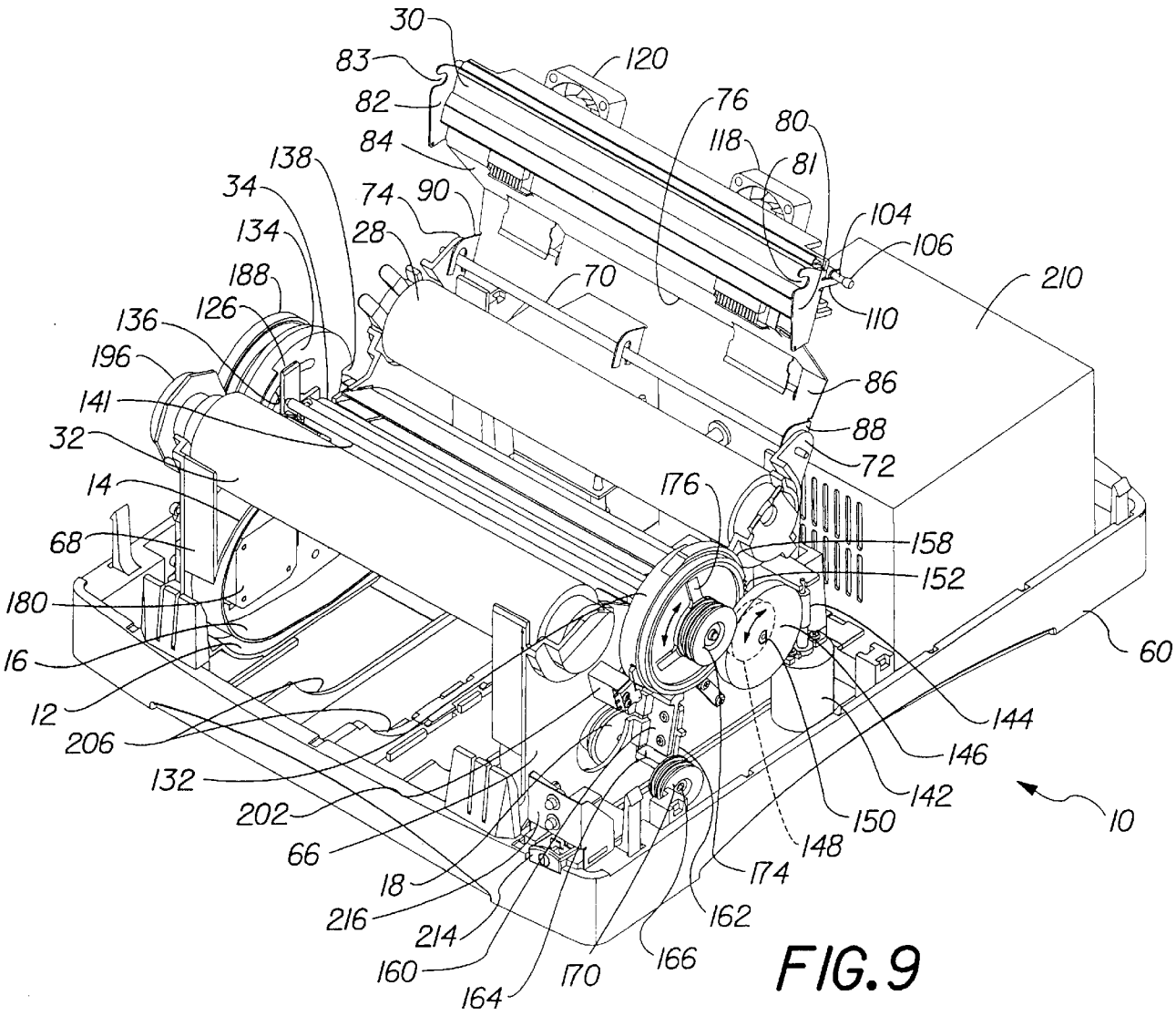
FIG. 9 illustrates a perspective view of the printer of FIG. 7, in which for illustrative purposes an upper housing cover and a pair of drive belts have been removed; and the print head and its sheet metal support have been pivoted upward.
Figure 17:
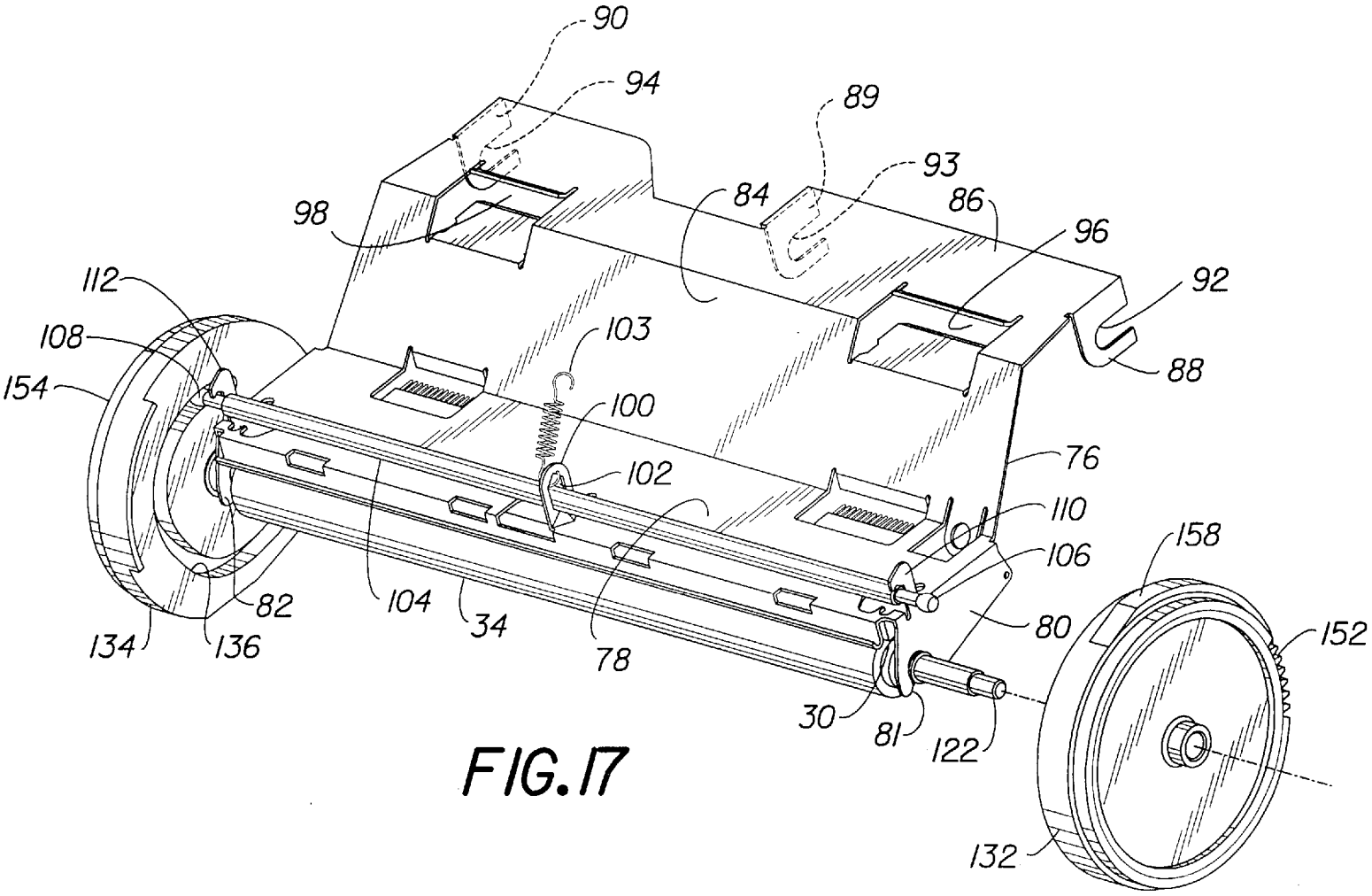
FIG. 17 illustrates a perspective view, partially exploded, of a front and a right side of a print head assembly in accordance with the invention.

As best seen in FIGS. 7,9 and 17, thermal print head 30 is supported by a sheet metal bracket 76 having a mounting panel 78 beneath which the print head is attached. A pair of end flanges 80, 82 extend downwardly from opposite ends of the mounting panel and include open, rounded end slots 81, 83 for engaging opposite ends of a central shaft of the platen, as will be explained subsequently. An integral connecting panel 84 extends upwardly and rearwardly from mounting panel 78 to join an integral hinge panel 86. Formed at opposite ends of hinge panel 86 are downwardly depending hinge flanges 88, 90 which include open, rounded end slots 92,94 which loosely engage tie bar 70 just in board of flanges 72,74, respectively. Between flanges 88,90 a depending hinge flange 89 is provided with an open, rounded end slot 93 which closely engages tie bar 70 midway between flanges 88,90. This arrangement of hinge flanges enables the print head assembly both to rotate about tie bar 70 and to swing side to side about flange 89, as the head is moved into engagement with the platen. A pair of ports 96, 98 are formed in connecting panel 94 for passage of electrical wiring, not shown.

Centrally on mounting panel 78 is formed an upwardly extended bracket 100 having a through opening 102. As shown in FIG. 17, a small coil spring 103 extends between bracket 100 and an anchor, not illustrated, on an underside of access door 64; so that, lifting the access door also will lift the print head to the position of FIG. 7, but lowering the print head toward the platen will apply only a modest tensile spring force to the access door. An elongated beam spring 104 extends through opening 102. Without departing from the invention, bracket 100 may be made adjustable upwardly and downwardly, to adjust head loading characteristics of the print head assembly. As illustrated, beam spring 104 preferably has a round cross section; however, other cross sections may be used without departing from the scope of the invention. At its opposite ends, beam spring 104 includes cam follower tips 106, 108 which extend laterally beyond mounting panel 78 to permit engagement with actuating cams to be described subsequently. A pair of retainer hooks 110, 112 are formed at opposite ends of the mounting panel to engage the beam spring in board of tips 106, 108 and lightly preload the beam spring against bracket 100. As a result, the beam spring also is held in proper location relative to bracket 76 as the bracket is moved toward or away from the platen. Preloading the beam spring also reduces the amount of deflection to be done by the disk cams to be discussed subsequently. Thus, bracket 100 acts as a fulcrum member when the beam spring is deflected. As best seen in FIGS. 8, 9, 11, 13 and 29, an elongated finned heat sink 114 is mounted on an upper side of mounting panel 78 to absorb and dissipate excess heat from print head 30. Preferably, the fins of the heat sink extend parallel to the platen, to provide additional stiffness. A slot 116 in the heat sink provides room for the beam spring. A pair of air circulation fans 118, 120 are provided to help remove heat.

Figure 16:
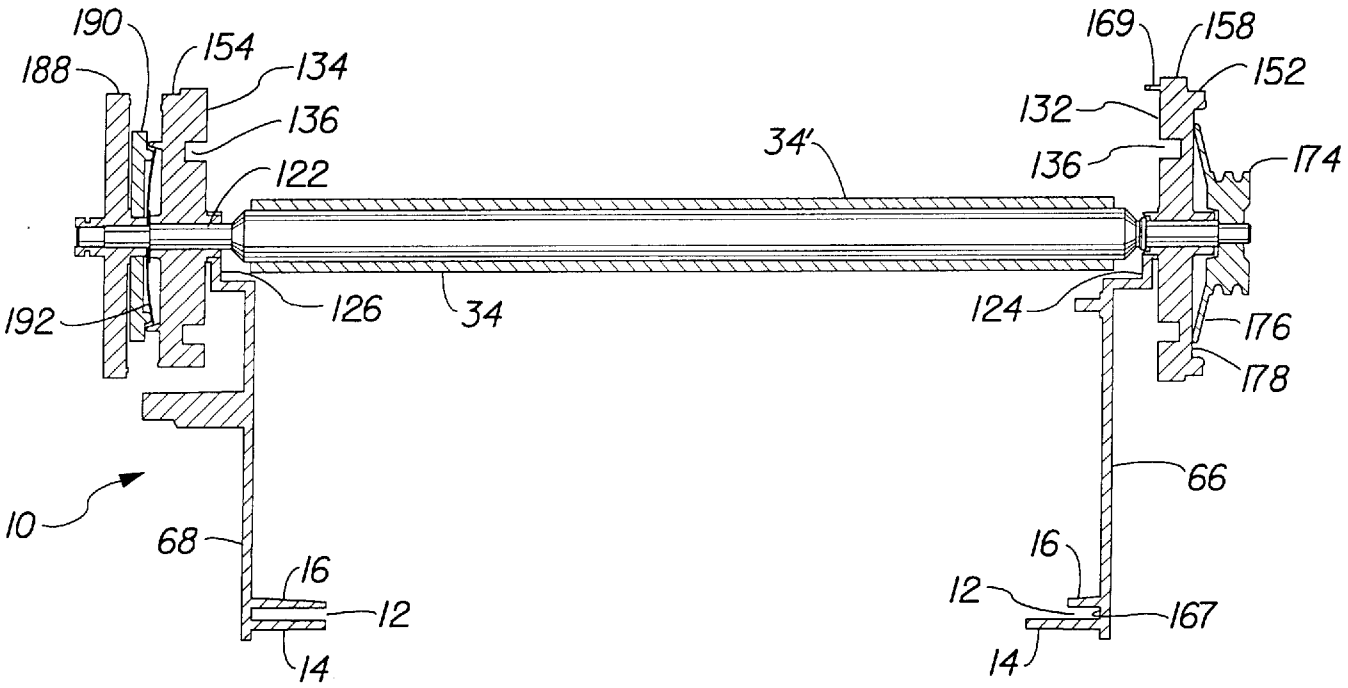
FIG. 16 illustrates a simplified sectional view taken along line 16—16 of FIG. 13.
Figure 18:
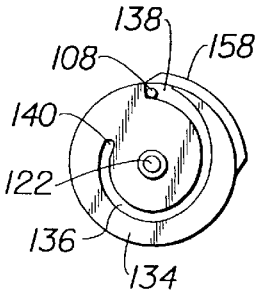
FIGS. 18 and 19 illustrate schematically positions of the platen, print head assembly and spiral cams when the print head has been fully raised from the platen.

As best seen in FIGS. 16 and 17, platen 34 comprises a central cylindrical portion formed by a resilient outer sleeve 34' through which passes a rigid central shaft 122. Bearing support flanges 124, 126 in support plates 66, 68 are provided to fixedly position the platen for rotation during printing. When the print head is lowered to define a nip with the platen, rounded end slots 81, 83 slip over opposite ends of shaft 122 in board of the bearing support flanges. Preferably, a circumferential groove, not illustrated, is provided in one of the opposite ends, to engage one of end slots 81, 83 and facilitate axial location of the print head assembly. Outboard of support flanges 124, 126, a pair of disk cams 132, 134 are mounted for free rotation on opposite ends of shaft 122. As best seen in FIGS. 17 and 18, each disk cam includes an essentially spiral shaped slot 136 into which extends a respective one of cam follower tips 106, 108. Each slot 136 begins, at a maximum radius from a center of shaft 122, with an opening 138 to a periphery of its respective cam. From opening 138, the radius of slot 136 from the center of shaft 122 decreases, eventually reaching a minimum at an end 140 of the slot. Thus, when the printer head assembly of FIG. 17 is lowered toward the platen, cam follower tips 106, 108 will enter slot 136 through opening 138. Then, as will be discussed in more detail subsequently, rotation of disk cams 132, 134 causes the follower tips to engage with the walls of slot 136 to move the print head toward the platen. Those skilled in the art will appreciate that, rather than rotatable disk cams, a pair of translating cams with a curved slots for tips 106, 108 could be used to move the print head assembly. When the print head is fully engaged with the platen, dye donor web 31 wraps partially over a guide roller 141 which extends between mechanism support plates 66, 68 just in front of and above the platen. Roller 141 is visible in FIGS. 7, 8, 9, 13, 26, 29 and 30. By wrapping the dye donor web over roller 141, the web is prevented from moving forward with the receiver sheet and is directed positively toward take-up roll 32.

Figure 8:
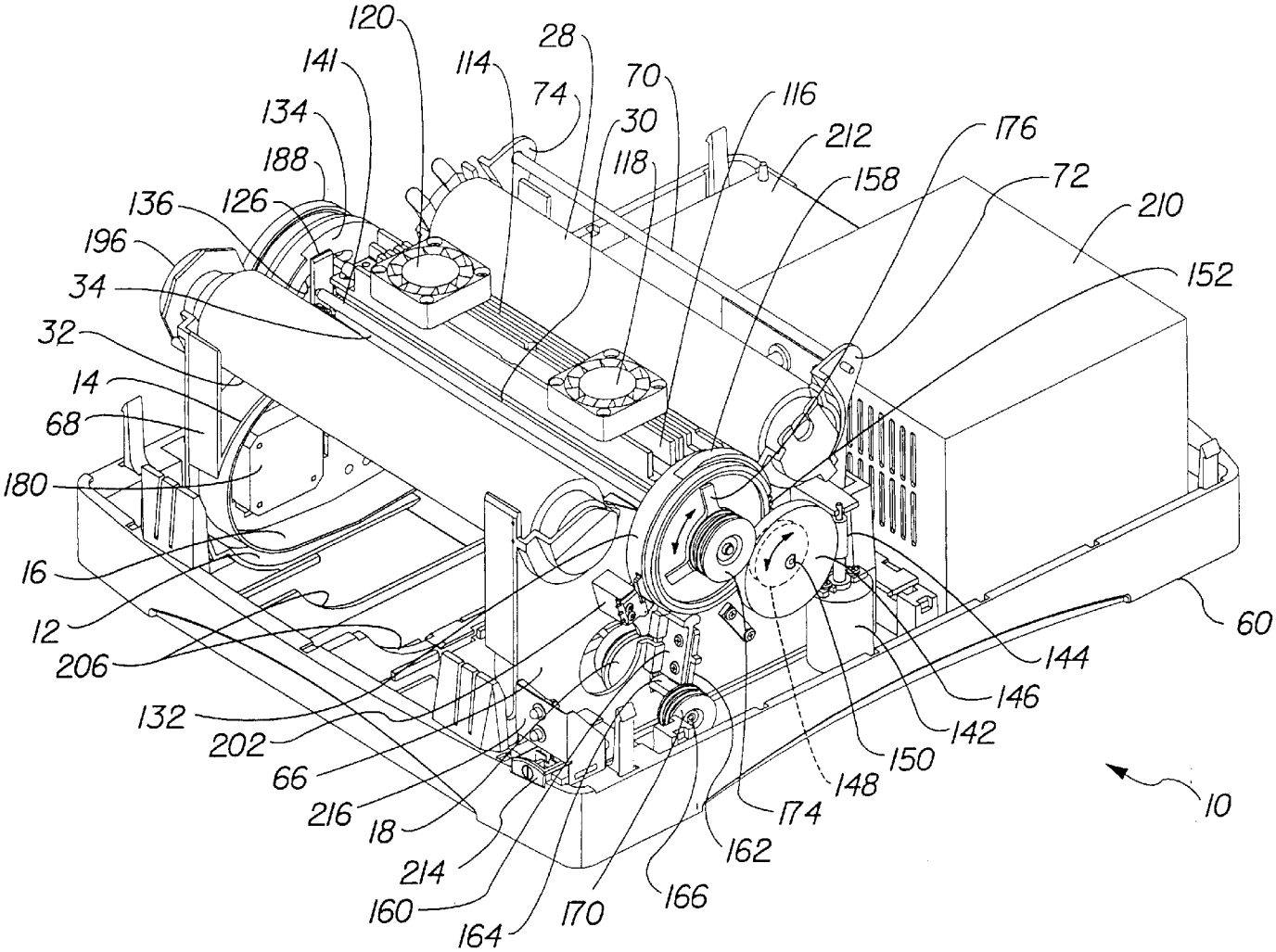
FIG. 8 illustrates a perspective view of the printer of FIG. 7, in which for illustrative purposes an upper housing cover, a sheet metal support for the print head, and a pair of drive belts have been removed; and the print head is in a lowered position.
Figure 10:
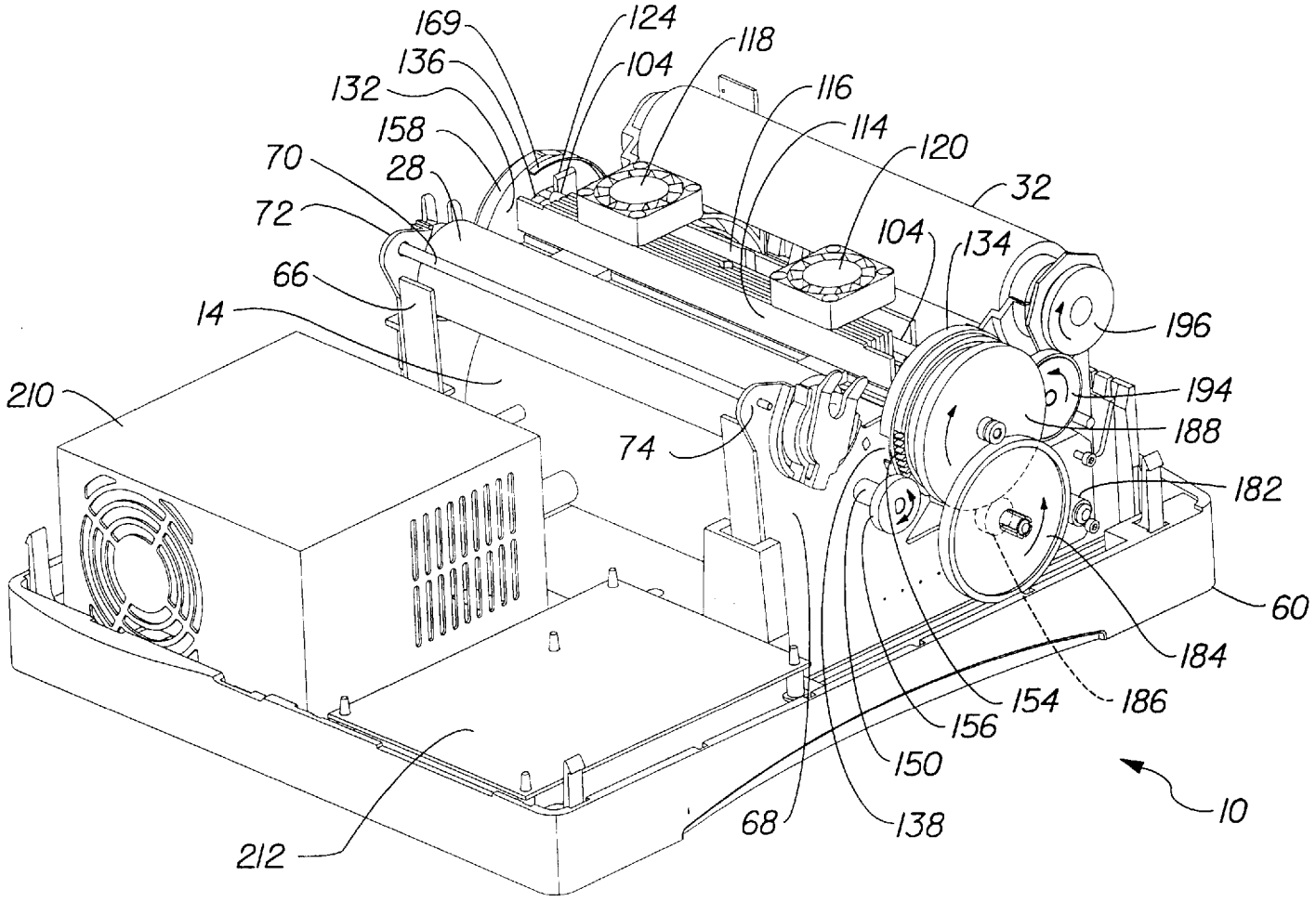
FIG. 10 illustrates a perspective view of a back and a left side of the printer of FIG. 8, as seen from an opposite corner.
Figure 11:
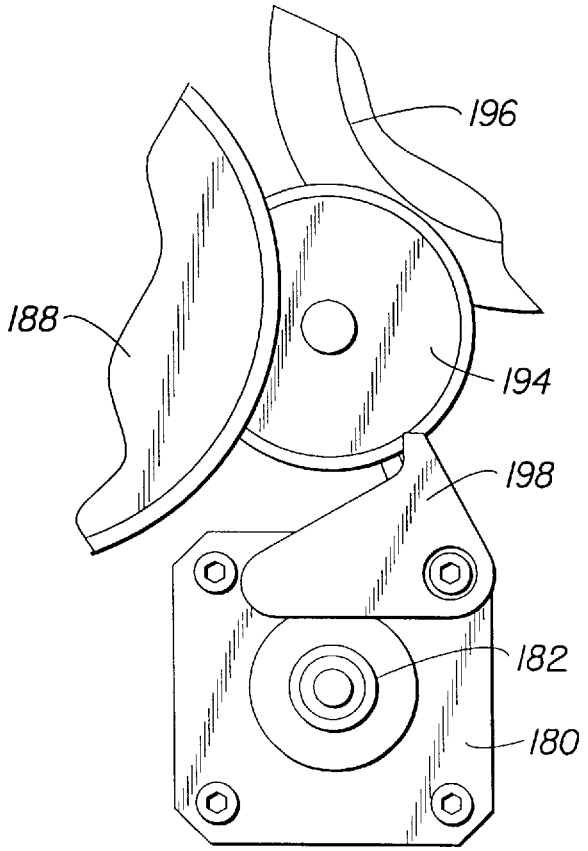
FIG. 11 illustrates a fragmentary view of a gear train visible in FIG. 10, but including an anti-reverse pawl which engages a gear in the gear train.

Rotation of disk cams 132, 134 is achieved with a drive train best seen in FIGS. 8, 9 and 11. A motor 142 is mounted on an outside surface of right support plate 66. A worm gear 144 is mounted on an output shaft of motor 142 in position to mesh with a driven gear 146 supported for rotation by plate 66. A further driven gear 148 is mounted coaxially for rotation with gear 146, as indicated in phantom in FIGS. 8 and 9. Gears 146, 148 are fixed to a shaft 150 which extends from plate 66 to plate 68. See also FIG. 10. On the outer diameter of disk cams 132, 134 are provided gear sectors 152, 154 which mesh, respectively, with gear 148 and a gear 156 provided on an opposite end of shaft 150, as seen in FIG. 10. Thus, motor 142 can be driven in either direction to rotate disk cams 132, 134 and cause the print head to move toward or away from the platen.

Figure 19:
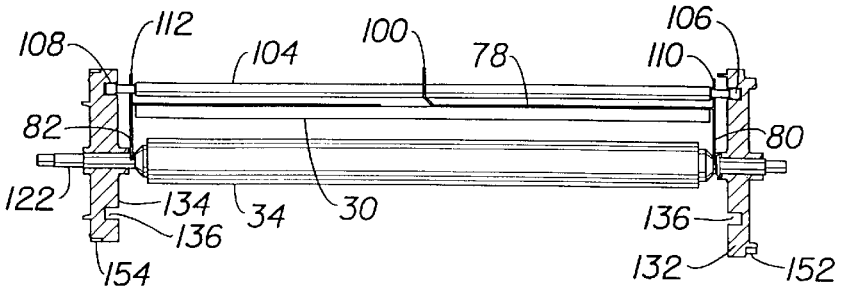
Figure 20:
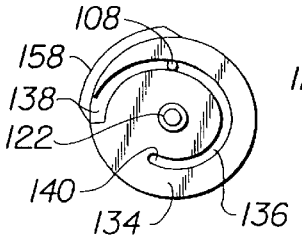
FIGS. 20 and 21 illustrate schematically positions of the platen, print head assembly and spiral cams when the print head has been lowered to just above the platen.
Figure 21:
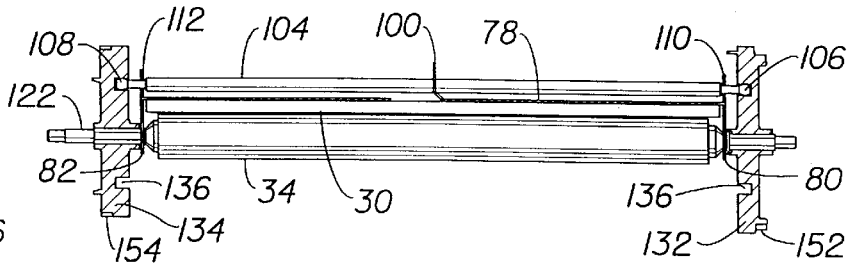
Figure 22:
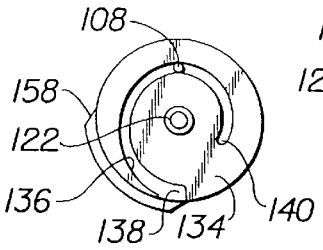
FIGS. 22 and 23 illustrate schematically positions of the platen, print head assembly and spiral cams when the print head has been lowered to engage the platen and press either the dye donor web alone, or the dye donor web and receiver sheet, in the nip between the print head and platen.
Figure 23:
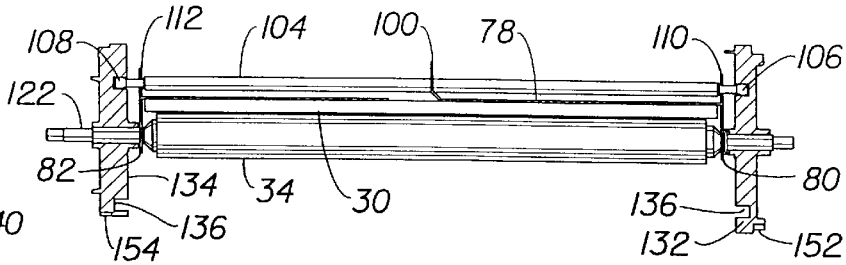
Figure 24:
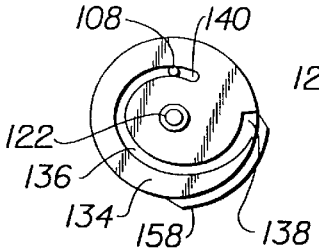
FIGS. 24 and 25 illustrate schematically positions of the platen, print head assembly and spiral cams when the beam spring has been deflected by the spiral cams to provide pressure needed both for printing onto the receiver sheet and for transporting one or both of the dye donor web and the receiver sheet.
Figure 25:
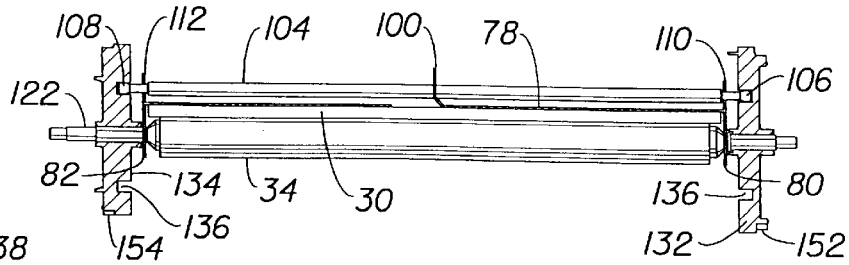

FIGS. 18 to 25 illustrate how rotation of the disk cams positions the print head. In FIGS. 18 and 19, the cam follower tips 106, 108 have just entered slot 136 through opening 138 and the print head is well spaced from the platen. When the disk cams are rotated about ninety degrees to the positions of FIGS. 20 and 21, the cam follower tips ride down the radially inner side of slots 136 and the print head moves downward to just above the platen. During the next ninety degrees of rotation to the positions of FIGS. 22 and 23, the cam follower tips continue to ride down the inner side of slots 136 and the print head moves into contact with the platen to establish a nip for transporting the dye donor web and receiver sheet. During the next ninety degrees of rotation to the positions of FIGS. 24 and 25, the cam follower tips move into engagement with the radially outer side of slots 136 as beam spring 104 is deflected to press the print head into engagement with the dye donor web, the dye donor web into engagement with the receiver sheet and the receiver sheet into engagement with the platen. Those skilled in the art will appreciate that by proper selection of the bending strength of the beam spring, the force of engagement will be sufficient (a) for thermal transfer of dye to the receiver sheet upon operation of the print head and (b) for transport of either the dye donor web alone or both the dye donor web and the receiver sheet upon rotation of the platen.

Figure 26:
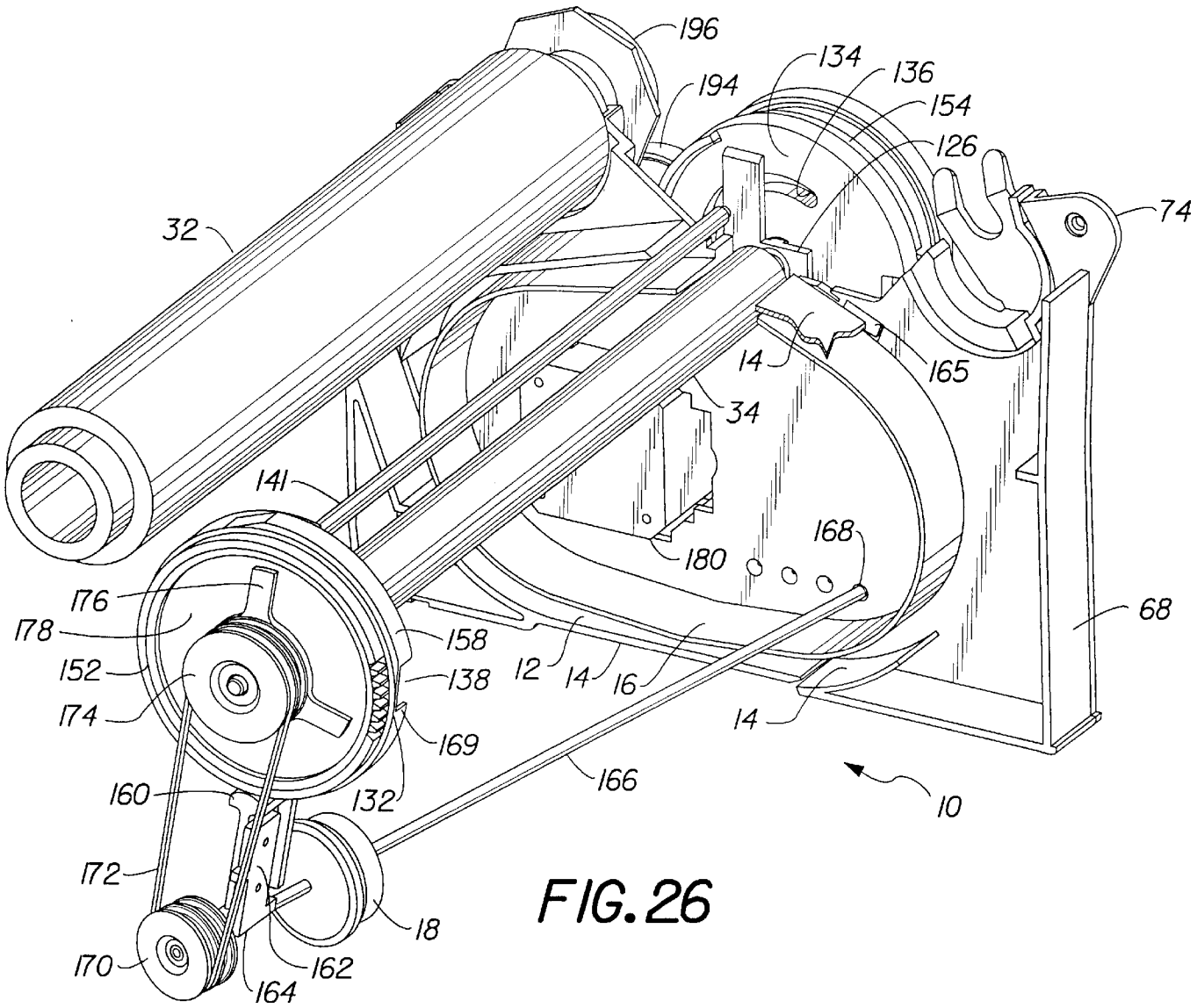
FIG. 26 illustrates a perspective view of a right and back side of the printer of FIG. 8, with a right mechanism support plate removed for ease of illustration.

As seen in FIGS. 8, 9, 13, 17 and 26, disk cam 132 on the right side of the printer includes on its periphery a radially extended lobe 158 which covers an arc of about ninety degrees beginning at opening 138 and proceeding along the periphery opposite slot 136. See also FIGS. 18, 20, 22, and 24. A cam follower 160 is supported by a slide 162 mounted on an outside surface of right mechanism support plate 66. At its lower end, cam follower 160 includes a shaft engagement shoe 164 which makes line contact with an upper portion of an elongated shaft 166 on which urge roller 18 is fixedly mounted. An opposite end of shaft 166 is supported for rotation in a bearing pocket 168 formed in an inside surface of left mechanism support plate 68, as best seen in FIG. 26. For adjustment of the angle of the urge roller, additional bearing pockets may be provided, not illustrated. Cam follower 160 is held against the periphery of disk cam 132 by a pair of resilient drive belts 172, to be described shortly. So, when disk cam 132 is rotated, lobe 158 will move into and out of engagement with cam follower 160, thus causing urge roller 18 to be moved into and out of engagement with the receiver sheet. Simultaneously, print head 34 is moved out of and into engagement with the platen due to interaction between spiral slots 136 and cam follower tips 106, 108, as previously described.

As shown in FIG. 16, pathway 12 is partially defined between portions of guide walls 14, 16 which extend inwardly toward each other from mechanism support plates 66, 68. During printing, receiver sheet 22 must be held perpendicular to print head 30 as the receiver sheet is driven forward by platen 34. To maintain such perpendicularity in accordance with the invention, the axis of rotation of urge roller 18 is skewed slightly at an acute angle to the direction of movement of the receiver sheet through pathway 12. As a result, upon rotation of the urge roller, a right edge of the receiver sheet will be driven against a flat, vertical guide surface 167 formed on support plate 66 between its respective guide walls 12, 14. For example, shaft 166 may be skewed about ten degrees out of parallel with the axis of rotation of platen 34. Thus, when urge roller 18 is rotated in contact with a receiver sheet, a right edge of the sheet will be forced to engage guide surface 167.

Figure 14:
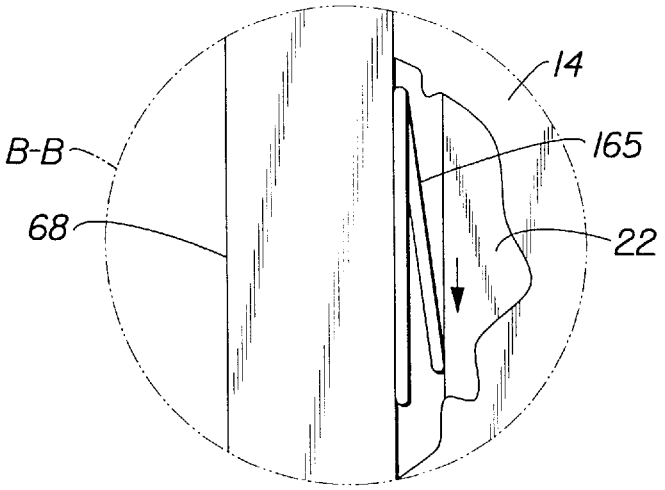
FIG. 14 illustrates a fragmentary view B—B of FIG. 13, showing a biasing spring for urging a receiver sheet toward an opposite side of the printer.
Figure 12:
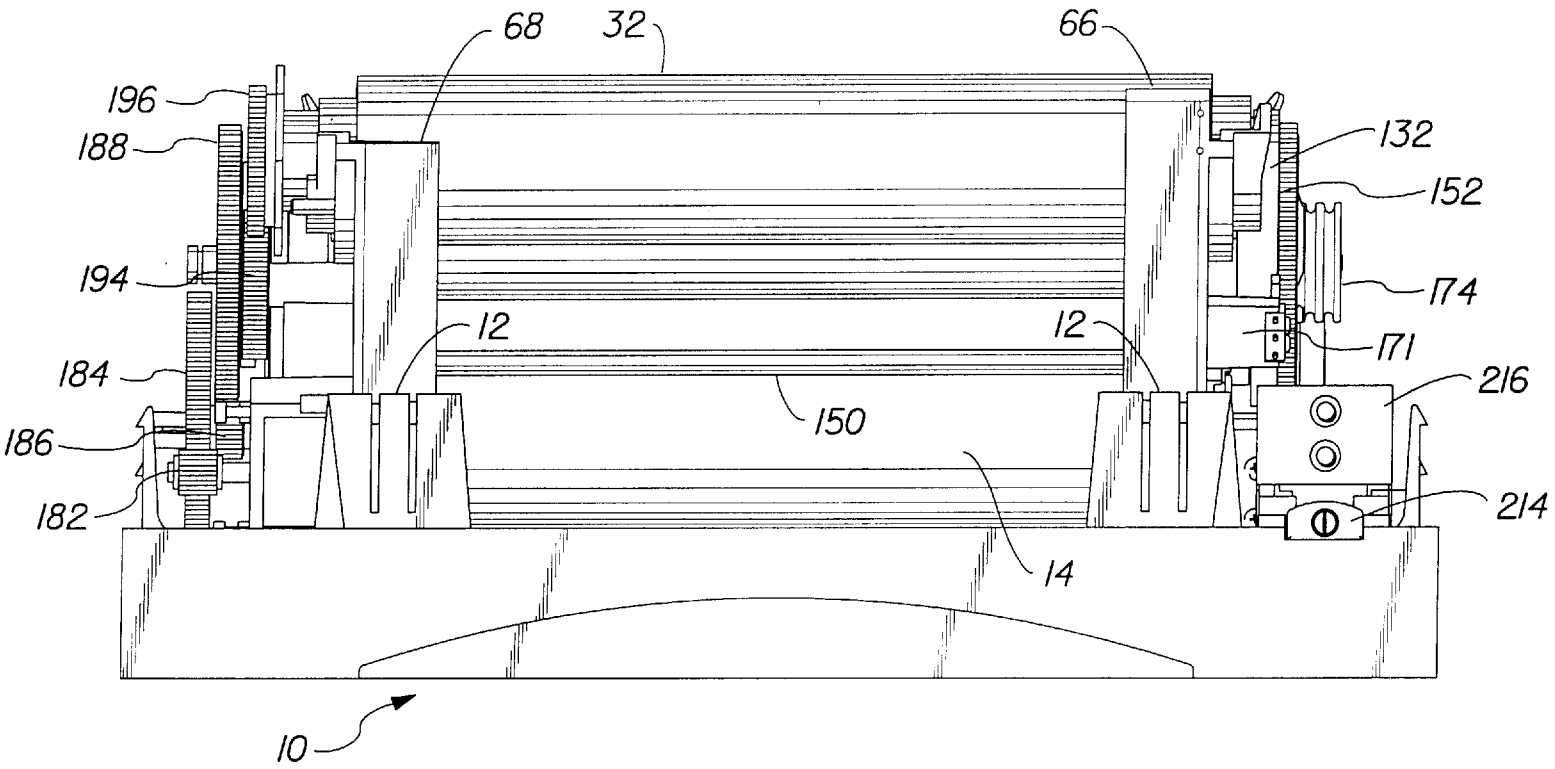
FIG. 12 illustrates a front elevation view of the printer of FIG. 8.
Figure 13:
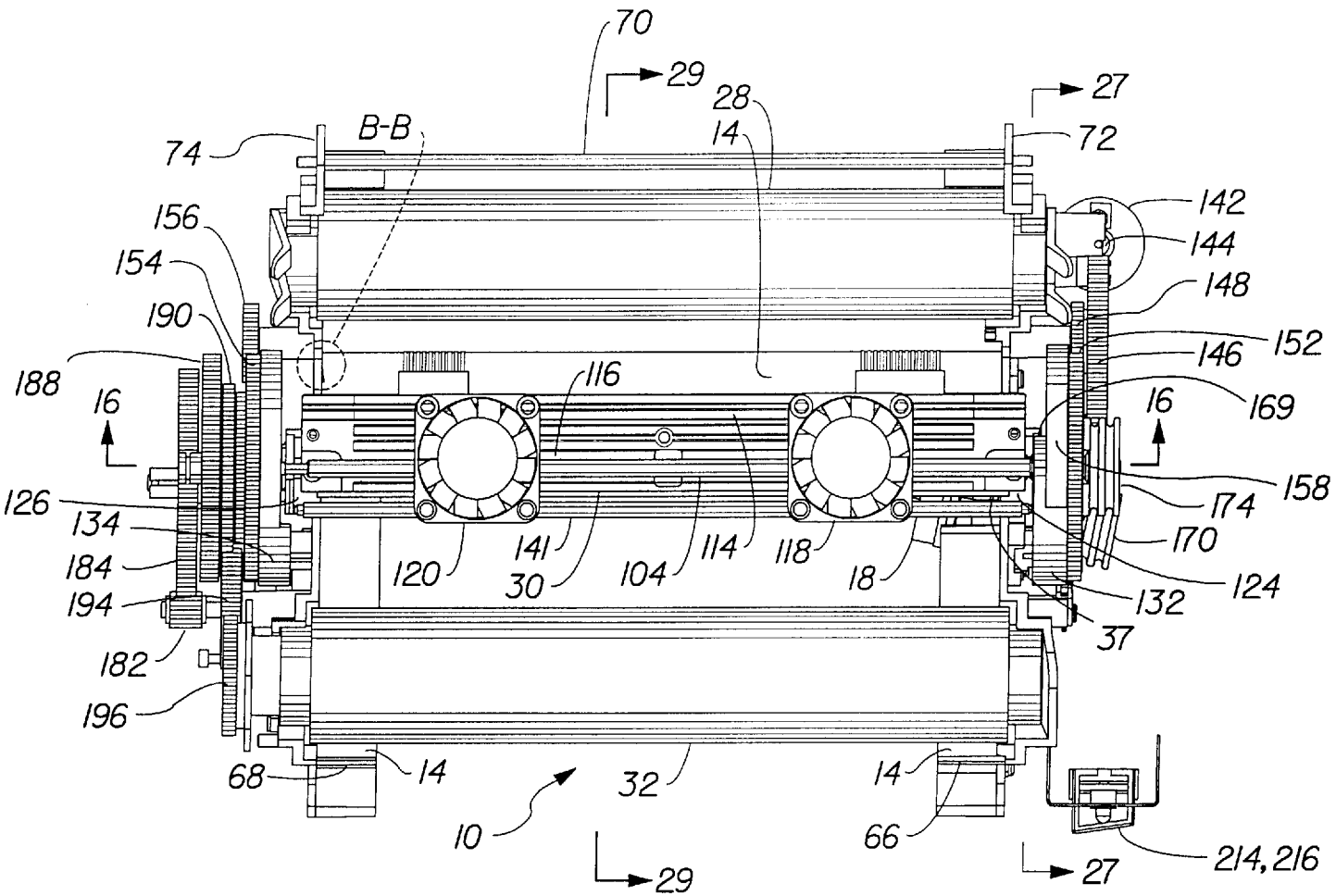
FIG. 13 illustrates a top plan view of the printer of FIG. 8.
Figure 15:
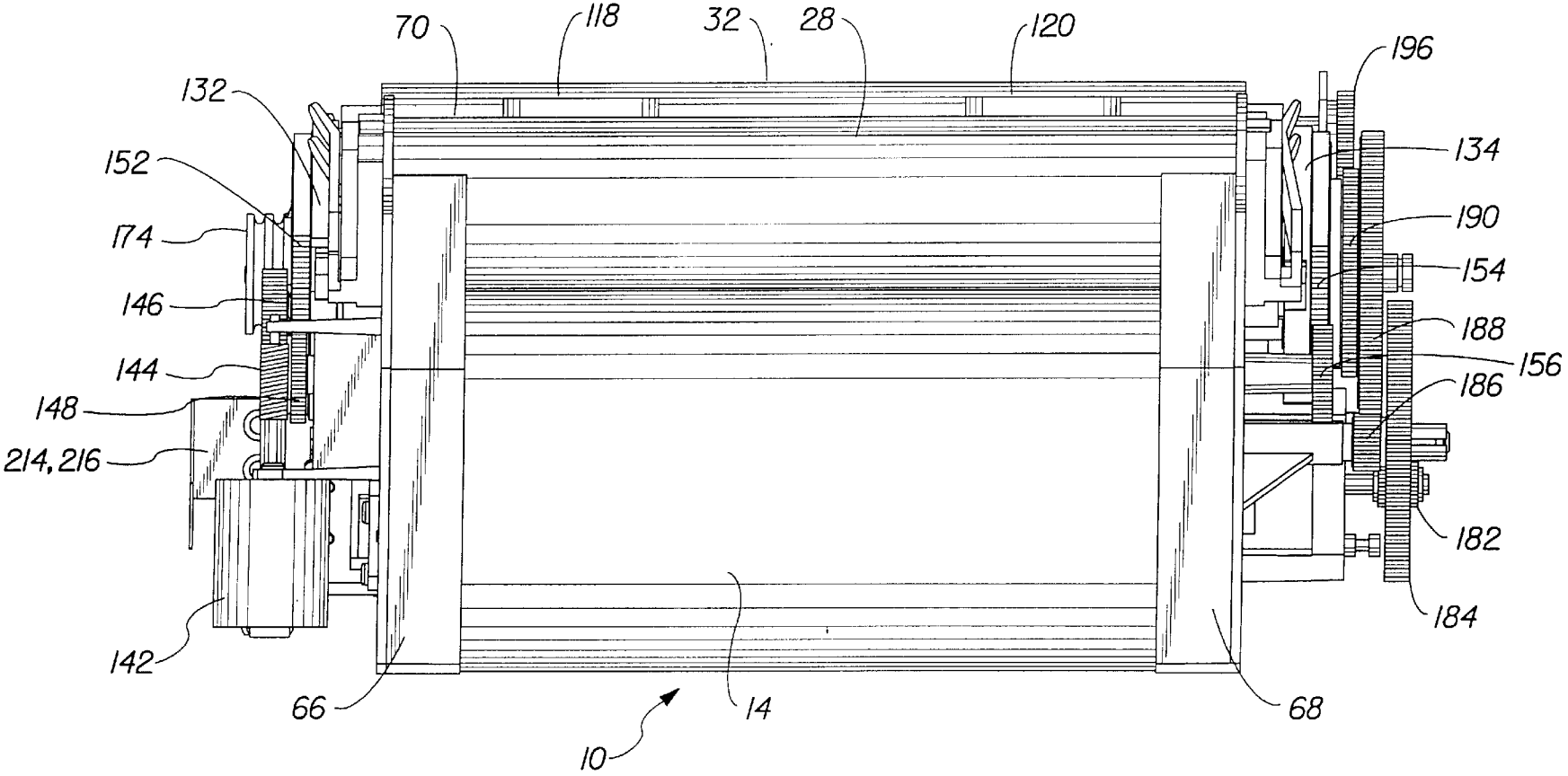
FIG. 15 illustrates a back elevation view of the printer of FIG. 8.

Although urge roller 18 has been demonstrated to repeatably locate a receiver sheet against guide surface 167 along most of the length of pathway 12 from the urge roller to the print head, occasionally a receiver sheet has been observed to move away slightly from surface 167 as leading edge 24 nears the print head. This appears to be caused by the inherent stiffness of the receiver sheet as the sheet approaches the print head. To eliminate this movement, which could lead to misregistration among successive printing passes, a small leaf spring 165 is mounted as shown in FIGS. 13, 14 and 26. Spring 165 is attached on an inside surface of left mechanism support plate 68 just upstream of the platen, where the spring will engage a left edge of any misaligned receiver sheet 22 and push the sheet back against guide surface 167 on the opposite side of the printer.

Figure 27:
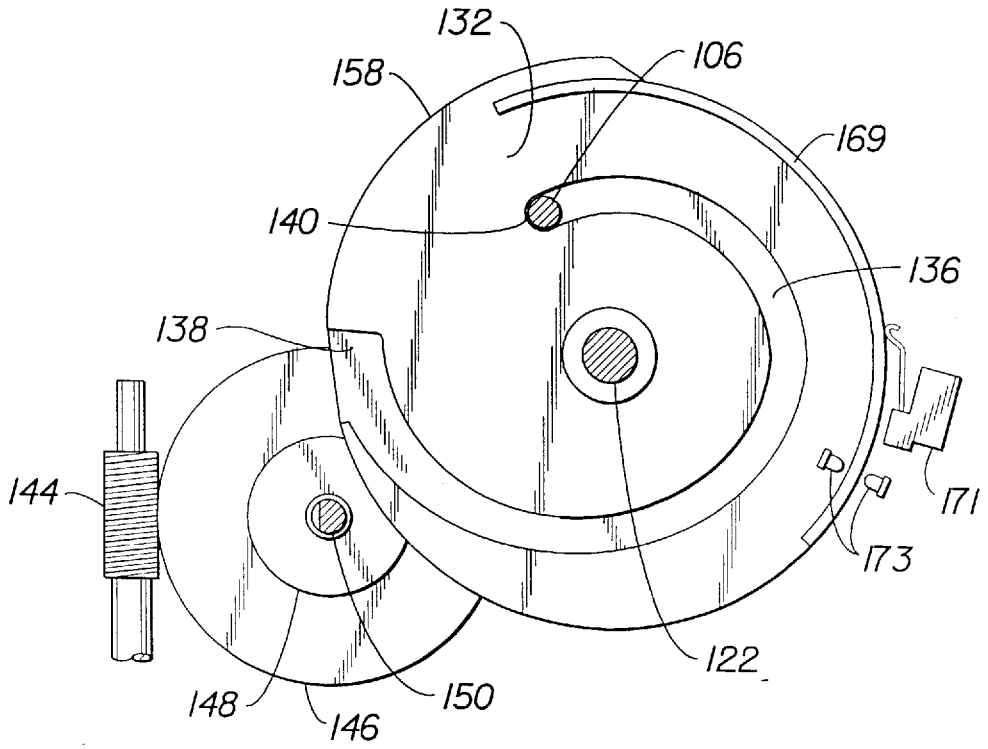
FIG. 27 illustrates a view taken along line 27—27 of FIG. 13, with the right mechanism support plate removed for ease of illustration.
Figure 28:
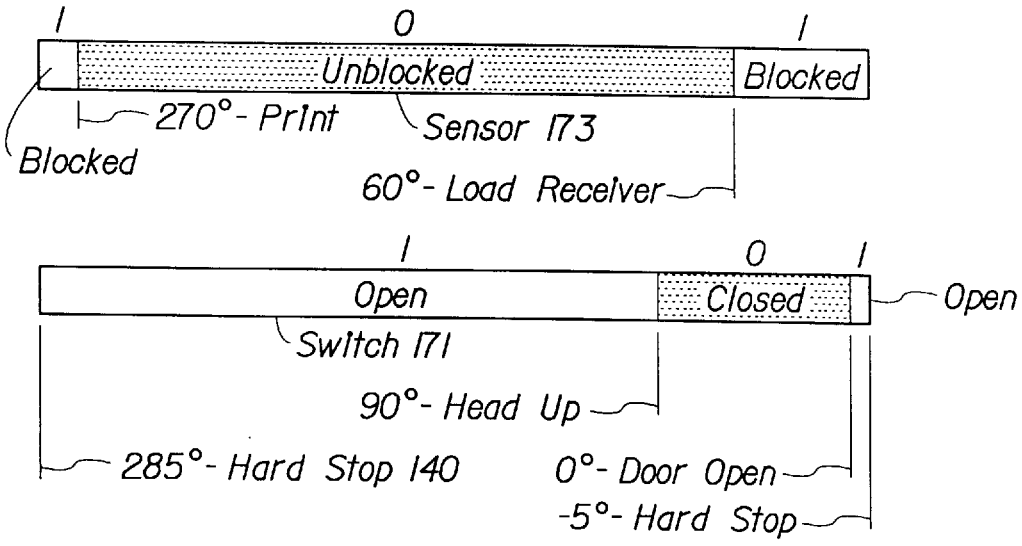
FIG. 28 illustrates a timing diagram of an optical sensor and a limit switch which are actuated as the disk cam of FIG. 27 is rotated.
Figure 29:
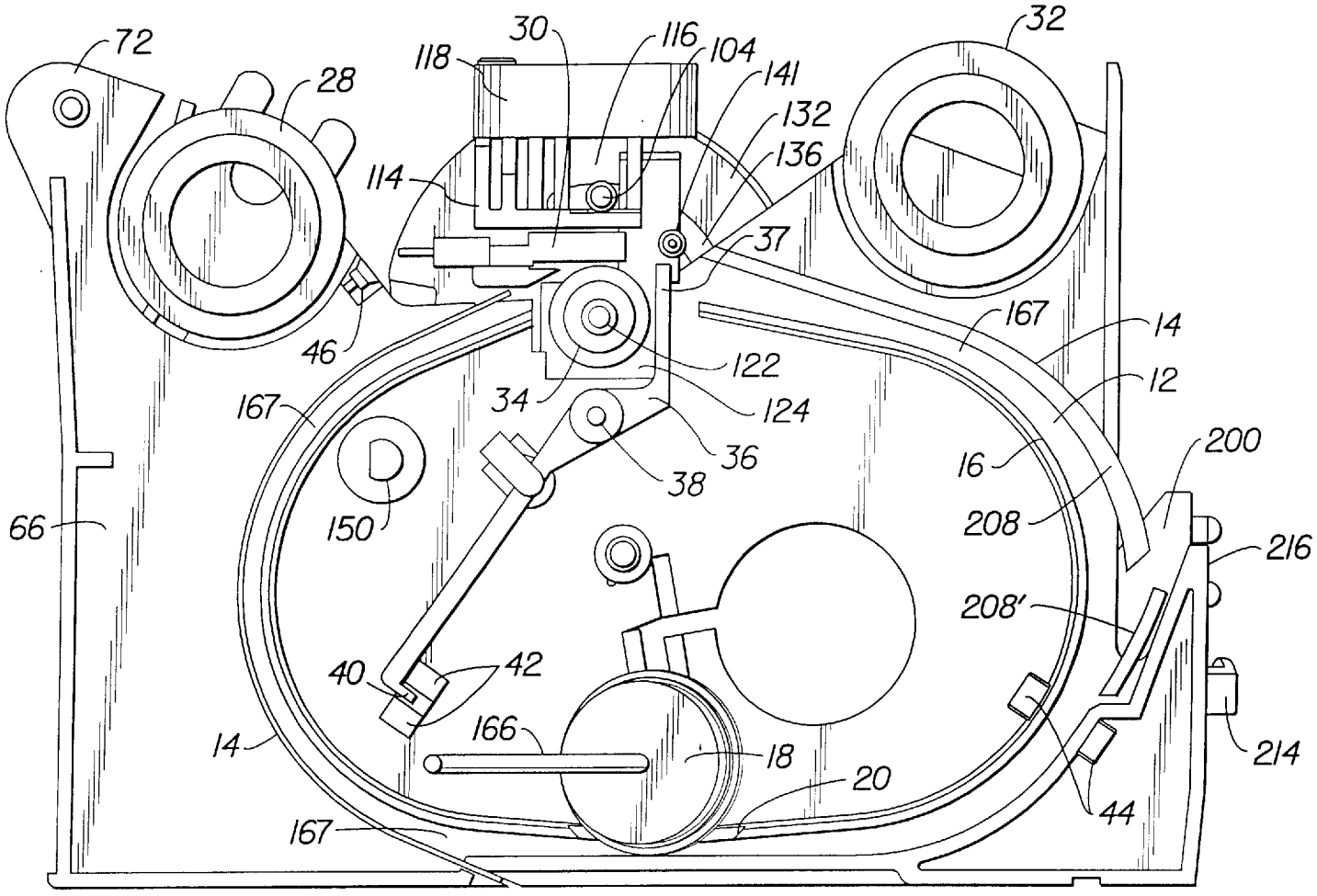
FIG. 29 illustrates a view taken along line 29—29 of FIG. 13, with a left mechanism support plate removed for ease of illustration.

Referring now to FIGS. 27 and 28, disk cam 132 includes an axially extended sensor actuation flange 169, also partially visible in FIGS. 13 and 16. Flange 169 overlaps lobe 158 by about twenty-five degrees and extends peripherally for about two hundred and ten degrees. Mounted on an outer surface of right mechanism support plate 66 are a limit switch 171 which engages lobe 158 and an optical sensor 173, similar to sensors 42 and 44, which cooperates with actuation flange 169. FIG. 27 shows disk cam 132 as oriented when print head 30 has been fully engaged with platen 34 and cam follower tip 106 is nearly at the end 140 of spiral slot 136. In this orientation, switch 171 is open in a logic "one" condition; and sensor 173 is blocked by flange 169, also in a logic "one" condition. When the disk cam is rotated counter-clockwise to raise the print head, sensor 173 is unblocked after about fifteen degrees rotation to produce a logic "zero" condition, at which point printing is stopped. After a further rotation of about one hundred and eighty degrees, switch 171 is closed to a logic "zero" condition upon encountering lobe 158 near opening 138 into spiral slot 136, at which point the print head has been raised well above the platen. After a further rotation of about thirty degrees, sensor 173 again is blocked by flange 169 to produce a logic "one" condition. After another sixty degrees, switch 171 moves off lobe 158 and closes to produce a logic "one" condition, indicating that access door 64 has opened. After about five degrees of further rotation, cam follower tip 106 is positioned in opening 138. The outputs from switch 171 and sensor 173 are directed to a conventional controller for the apparatus, to be discussed subsequently. The relative positions of switch 171 and sensor 173 also may be used to detect the position of the apparatus at any given time in its cycle.

Figure 30:
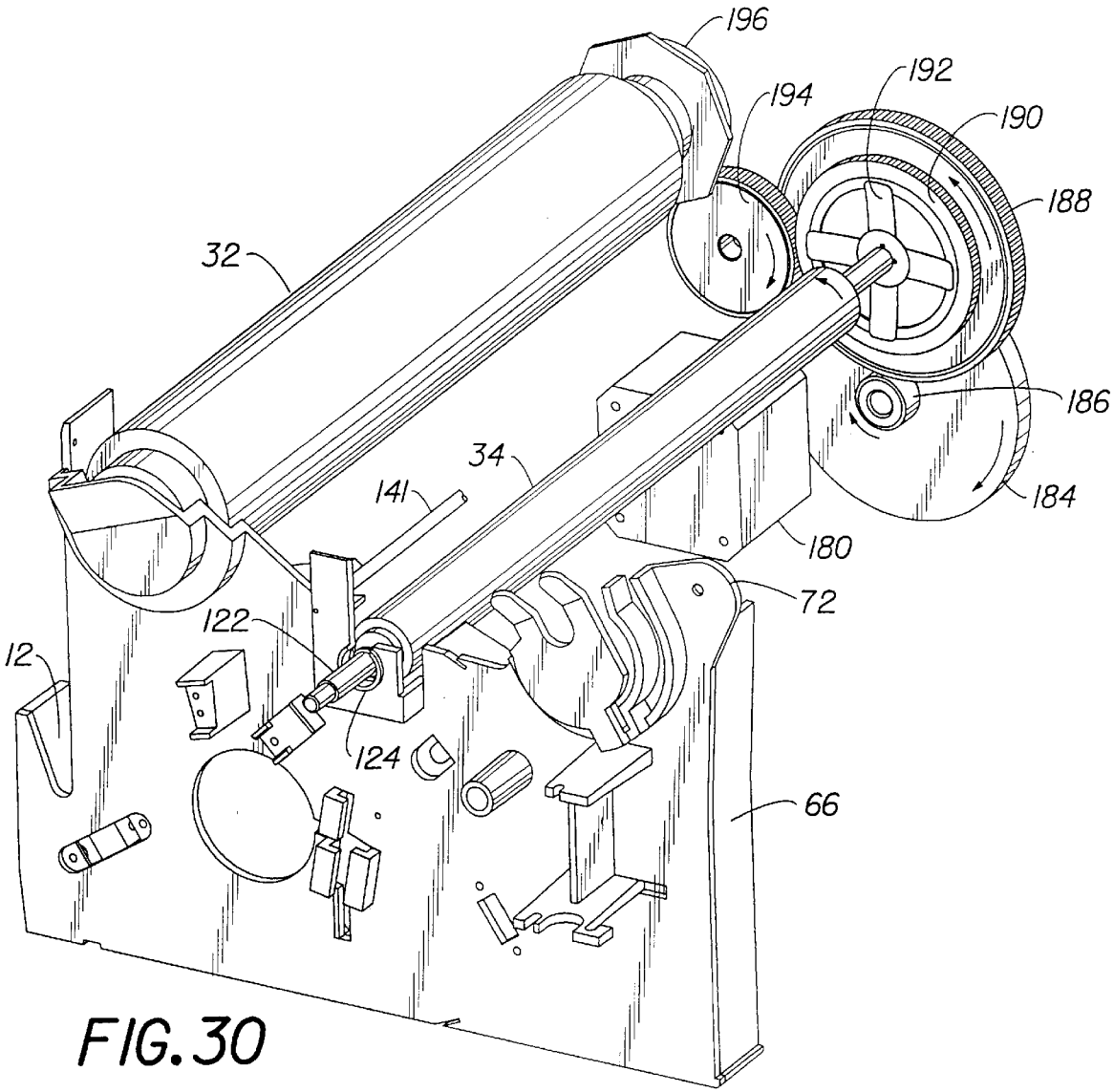
FIG. 30 illustrates a simplified perspective view of a right and back side of the printer of FIG. 8, with a left mechanism support plate and a left spiral cam removed for ease of illustration.

Urge roller 18 and platen 34 share a common drive train. A double-grooved pulley 170 is mounted fixedly on a right end of shaft 166 outboard of engagement shoe 164. A pair of O-ring belts 172 extend upward from pulley 170 to a similar pulley 174 mounted fixedly on a right end of central shaft 122, outboard of disk cam 132. Belts 172 are stretched into engagement with pulleys 170, 172, thereby creating a tension which holds cam follower 160 in engagement with the periphery of disk cam 132. Of course, a single grooved pulley and single belt could be used. A spring 176, visible in FIGS. 8, 9 and 16, is fixedly mounted to pulley 174 and engages a radially extended surface 178 on disk cam 132, thereby providing an axial load on the shaft of the platen toward the right side of the printer to prevent axial movement of the platen which would influence registration with the print head. On the left side of the printer, a stepper motor 180 is mounted on left mechanism support plate 68, as best seen in FIGS. 8, 9, 26 and 30. An output shaft of motor 180 extends outwardly of support plate 68 and mounts an output pinion gear 182. As best seen in FIGS. 10 to 13, 15, 16 and 30, a drive train extends from pinion 182 to platen 34. The drive train includes a driven gear 184 meshed with pinion 182 and a coaxial gear 186 meshed with a gear 188 mounted fixedly on central shaft 122 outboard of disk cam 134. As seen in FIG. 16, between gear 188 and disk cam 134, a gear 190 is mounted for rotation about central shaft 122. A clutch spring 192 is mounted fixedly to central shaft 122 to press gear 190 into frictional engagement with an inner side surface of gear 188. As seen in FIGS. 10 and 30, gear 190 meshes with a gear 194 rotatably supported on a shaft extended outwardly from support plate 68. Gear 194 meshes with a gear 196 fixedly attached to dye donor take-up roll 32. Preferably, gear 196 is overdriven slightly faster than platen 34; so that, a slight tension is maintained on the used dye donor web. Clutch spring 192 can slip to prevent application of excess tension. Finally, as shown in FIG. 11, an anti-reverse pawl 198 is pivotably mounted outboard of motor 180 in position to engage gear 194 and prevent reverse rotation of take-up roll 32, when a receiver sheet is ejected from the printer.

In operation of the printer, a sheet 22 of dye receiver is inserted into pathway 12 through an elongated opening 200 provided in housing cover 62. A plurality of ribs 206 are formed in an upper surface of base 60 to support and guide the sheet as it moves through pathway 12 in response to rotation of urge roller 18. As shown schematically in FIG. 29, housing cover 62 may support, inside opening 200, a pair of insertion/ejection guides 208, 208' which help to lead a receiver sheet into or out of the pathway. A power supply 210 and a conventional programmable controller 212, shown only schematically, are mounted to base 60 and operatively connected to the various motors, sensors, print head, fans and other components previously described. An on-off switch 214 is provided at the front of the printer, along with a pair of lights 216 for indicating the status of operation.

Those skilled in the thermal printer art will understand from the foregoing description that motor 142 drives disk cams 132, 134 to raise and lower print head 34. As the cams are rotated to raise and lower the print head, lobe 158 engages cam follower 160 to lower and raise urge roller 18 into and out of engagement with receiver sheet 22. At the same time, switch 171 and sensor 173 signal controller 212 when a receiver sheet may be loaded, when to start and stop printing, when the print head has been raised well above the platen to permit a receiver sheet to be advanced, and when the access door has been opened. Motor 180 drives platen 34 to move the dye donor web and receiver forward during printing and to move the dye donor web forward when the receiver sheet is being recirculated. During ejection of a completed print from the apparatus, the direction of rotation of motor 180 is reversed and motor 142 rotates the disk cams to lower the urge roller.

Parts List

10 . . . thermal printer apparatus
12 . . . closed loop pathway for receiver sheet 22
14 . . . outer guide wall
16 . . . inner guide wall
18 . . . urgeroller
20 . . . opening in 16 for 18
22 . . . receiver sheet or sheet
24 . . . leading edge
26 . . . trailing edge
28 . . . supply roll of dye donor web
30 . . . thermal print head
31 . . . web of dye donor
32 . . . take-up roll for dye donor web
34 . . . platen roller
34'. . . resilient outer sleeve on 34
35 . . . opening in 16 for 34
36 . . . leading edge sensor lever
37 . . . contact end of 36
38 . . . pivot for 36
40 . . . sensor flag on 36
42 . . . optical sensor for 40
44 . . . trailing edge sensor for 26
46 . . . sensor for lead edge of next dye triplet
60 . . . housing base
62 . . . removable housing cover
64 . . . access door
66 . . . right mechanism support plate
68 . . . left mechanism support plate

70 . . . tie bar
72, 74 . . . flanges on 66, 68
73, 75 . . . depending flanges on 64
76 . . . sheet metal mounting bracket
78 . . . print head mounting panel
80, 82 . . . downward end flanges
81, 83 . . . open, rounded end slots in 80, 82
84 . . . integral upward connecting panel
86 . . . hinge panel
88, 90 . . . downward hinge flanges
89 . . .
93 . . .
92, 94 . . . open, rounded end slots to engage 70
96, 98 . . . ports for electrical cabling
100 . . . central bracket
102 . . . opening in 100
103 . . . coil spring between 100 and 64
104 . . . elongated beam spring
106, 108 . . . cam follower tips
110, 112 . . . retainer hooks
114 . . . finned heat sink
116 . . . slot for 104
118, 120 . . . air circulation fans
122 . . . central shaft of 34
124, 126 . . . bearing support flanges
128, 130 . . .
132, 134 . . . disk cams rotatable on 122
136 . . . spiral slot in 132, 134
138 . . . opening at full radius
140 . . . minimum radius end of 136
141 . . . guide roller for 31
142 . . . motor
144 . . . worm gear
146 . . . driven gear
148 . . . driven gear coaxial with 146
150 . . . shaft for 146, 148
152, 154 . . . gear on 132, 134
156 . . . gear on left end of 150
158 . . . radially extending lobe
160 . . . cam follower
162 . . . slide
164 . . . engagement shoe
165 . . . leaf spring to engage sheet 22
166 . . . shaft for 18
167 . . . flat, vertical guide surface between 12, 14 on 66
168 . . . bearing pocket in 68 for 166
169 . . . sensor actuation flange 25
170 . . . pulley on 166
171 . . . limit switch for 158
172 . . . O-ring drive belts 208,
173 . . . optical sensor for 169
174 . . . pulley on 122
176 . . . spring arms from 176
178 . . . radially extended surface on 132
180 . . . stepper motor
182 . . . output pinion
184 . . . driven gear
186 . . . gear coaxial with 184
188 . . . driven gear fixed on 122
190 . . . gear rotatable on 122
192 . . . clutch spring to push 190 against 188
194 . . . gear driven by 190
196 . . . gear on 32 driven by 194
198 . . . anti-reverse pawl engaging 194
206 . . . ribs on upper surface of 60
208, 208'. . . insertion/ejection guides into
210 . . . power supply
212 . . . control board
214 . . . on/off switch
216 . . . status lights While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure letters patent for:

1. A thermal printer for printing onto a receiver sheet having a leading edge and a trailing edge, the printer comprising:

an elongated rotatable platen having a peripheral surface;

an elongated thermal print head positioned parallel to the platen;

a closed loop pathway for recirculating a receiver sheet in a printing direction from the platen and back to the platen, the platen being positioned for rotation in the printing direction with at least a portion of the peripheral surface in the pathway to engage a receiver sheet or a dye donor web;

a supply roll of dye donor web positioned up stream of the print head;

means for moving the print head into the pathway opposite the portion of the peripheral surface to press the print head into engagement with the dye donor web, the dye donor web into engagement with the receiver sheet, and the receiver sheet into engagement with the platen, with sufficient force (a) upon operation of the print head for thermal transfer of dye to the receiver sheet and (b) upon rotation of the platen in the printing direction for transport of either the dye donor web or both the dye donor web and the receiver sheet between the print head and the platen;

means for rotating the platen in the printing direction to move either the dye donor web or both the dye donor web and the receiver sheet between the print head and the platen; and means for recirculating the receiver sheet through the closed loop pathway in the printing direction for successive thermal transfers of different dyes from the dye donor web.

2. A thermal printer according to claim 1, wherein the means for recirculating comprises:

roller means extended into the pathway for urging the receiver sheet through the closed loop pathway in the printing direction;

means for sensing when the leading edge of the receiver sheet has passed between the platen and the dye donor web and for producing a signal; and means, responsive to the signal, for disengaging the roller means from the receiver sheet before printing commences.

3. A thermal printer according to claim 2, wherein the means for sensing detects the passage of the trailing edge of the receiver sheet just as the leading edge passes between the platen and the dye donor web.

4. A thermal printer according to claim 2, wherein the closed loop pathway includes an opening through which the receiver sheet web may be inserted into or ejected from the pathway.

5. A thermal printer according to claim 4, further comprising means for rotating the roller means opposite to the printing direction to eject the receiver sheet from the pathway.

6. A thermal printer according to claim 2, wherein the means for rotating the platen also rotates the roller means; the roller means is supported on a shaft; and the means for disengaging the roller means comprises:

a cam;

a cam follower engaging the cam and the shaft; and means for moving the cam to move the follower and the shaft, there by moving the roller means into or out of engagement with the receiver sheet.

7. A thermal printer according to claim 6, wherein the means for rotating comprises:

a first pulley mounted for rotation with the platen;

a second pulley mounted for rotation with the shaft and the roller means; and a resilient drive belt engaged with the first and second pulleys to transmit rotation to the roller means and to maintain engagement between the cam and the cam follower.

8. A thermal printer according to claim 7, wherein the platen comprises a central shaft having an end portion; the cam comprises a plate cam mounted for rotation around the end portion; and the means for moving rotates the cam, further comprising a slip clutch between the first pulley and the cam.

9. A thermal printer according to claim 6, wherein the platen comprises a central shaft having an end portion; the cam comprises a plate cam mounted for rotation around the end portion; and the means for moving rotates the cam.

10. A thermal printer according to claim 2, wherein the roller means is mounted for rotation on a shaft, the shaft being set at an acute angle to a direction of movement of the receiver sheet through the pathway.

11. A thermal printer according to claim 2, wherein the means for moving the print head also is responsive to the signal, further comprising:

means for sensing when the leading edge of the receiver sheet has reached a predetermined location downstream of the print head and for producing a further signal; and means, responsive to the further signal, for activating the print head to cause dye transfer between the dye donor web and the receiver sheet.

12. A thermal printer according to claim 11, wherein the means for sensing and producing a further signal comprises:

a pivoted sensor lever having a free end positioned downstream of the print head to be engaged by the leading edge; and means for detecting movement of the sensor lever upon moving contact between the free end and the leading edge.

13. A thermal printer according to claim 1, wherein the closed loop pathway comprises inner and outer guide walls between which the receiver sheet can be moved by the platen.

14. A thermal printer according to claim 1, further comprising a take-up roll positioned downstream of the printer head to receive dye donor web after passage thereof between the print head and the platen.

15. A thermal printer according to claim 14, wherein the means for rotating also rotates the take-up roll.

16. A thermal printer according to claim 15, wherein the means for rotating comprises:

a platen drive member fixedly mounted on a shaft of the platen;

a take-up drive member rotatably mounted on the shaft of the platen;

slip clutch means for causing the take-up drive member to rotate with the shaft of the platen;

means for transmitting rotation of the take-up drive member to the take-up roll.

17. A thermal printer according to claim 16, wherein the platen drive member and the take-up drive member are gears, and the means for transmitting is a gear train.

18. A thermal printer according to claim 16, further comprising means for preventing reverse rotation of the take-up roll.

19. A thermal printer according to claim 1, further comprising:

a first mechanism support plate;

a second mechanism support plate;

the platen being rotatably supported between the support plates; and inner and outer guide walls extended toward each other from the support plates to provide boundaries of the closed loop pathway.

20. A thermal printer according to claim 18, further comprising a base extended between the support plates, the base including ribs for guiding the receiver sheet.

21. A thermal printer according to claim 1, wherein the means for moving the print head comprises:

means for supporting the print head adjacent the platen;

an elongated beam spring having opposite ends;

a fulcrum member extended from the means for supporting to engage the beam spring between the opposite ends; and means for engaging the beam spring at the opposite ends to deflect the beam spring and thereby press the print head into engagement.

22. A thermal printer according to claim 21, wherein the means for engaging comprises a pair of movable cams, each cam having a respective slot of decreasing radius from an axis of rotation of the platen, each slot being engaged with one of the opposite ends; and means for moving the cams to cause the print head to be pressed into engagement with the dye donor web.

23. A thermal printer according to claim 22, wherein the slot of each cam also moves the beam spring and print head to position the print head in engagement with the dye donor sheet before deflecting the beam spring.

24. A thermal printer according to claim 22, wherein the slot of each cam also moves the beam spring and print head to position the print head out of engagement with the dye donor sheet after deflecting the beam spring.

25. A thermal printer according to claim 22, wherein each slot opens to a periphery of a respective cam, to permit the print head, fulcrum member and beam spring to be disengaged from the cams.

26. A thermal printer according to claim 25, wherein the means for supporting is pivoted to a frame of the printer to facilitate movement of the print head into and out of engagement with the dye donor web.

27. A thermal printer according to claim 26, further comprising a housing enclosing the printer, the housing having an access door and the means for supporting being connected to the access door, whereby pivoting the means for supporting raises the access door.

28. A thermal printer according to claim 27, wherein the access door and the means for supporting are coaxially pivoted to a frame of the printer.

29. A thermal printer according to claim 27, wherein the access door and the means for supporting are connected by a spring.

30. A thermal printer according to claim 21, wherein the means for engaging comprises a pair of rotatable cams, each cam having a respective slot of decreasing radius from an axis of rotation of the cam, each slot being engaged with one of the opposite ends; and means for rotating the cams to cause the print head to be pressed into engagement with the dye donor web.

31. A thermal printer according to claim 30, wherein each of the plate cams is mounted for rotation about a respective one of the shaft ends of the platen.

32. A thermal printer according to claim 30, wherein the slot of each cam also moves the beam spring and print head to position the print head out of engagement with the dye donor sheet before deflecting the beam spring.

33. A thermal printer according to claim 30, wherein the slot of each cam also moves the beam spring and print head to position the print head out of engagement with the dye donor sheet after deflecting the beam spring.

34. A thermal printer according to claim 30, wherein each slot opens to a periphery of a respective cam, to permit the print head, fulcrum member and beam spring to be disengaged from the cams.

35. A thermal printer according to claim 34, wherein the means for supporting is pivoted to a frame of the printer to facilitate movement of the print head into and out of engagement with the dye donor web.

36. A thermal printer according to claim 35, further comprising a housing enclosing the printer, the housing having an access door and the means for supporting being connected to the access door, whereby pivoting the means for supporting raises the access door.

37. A thermal printer according to claim 36, wherein the access door and the means for supporting are coaxially pivoted to a frame of the printer.

38. A thermal printer according to claim 37, wherein the access door and the means for supporting are connected by a spring.

39. A thermal printer according to claim 21, further comprising a pair of hooks extended from the means for supporting, one hook for engaging each of the opposite ends of the beam spring to bias the spring into contact with the fulcrum member.

40. A thermal printer according to claim 21, wherein the fulcrum member essentially is centered on the beam spring.

41. A thermal printer according to claim 21, further comprising a pair of end flanges extended from the means for supporting, each end flange being configured to engage one of the opposite shaft ends of the platen.

42. A thermal printer according to claim 30, wherein the means for recirculating comprises:

roller means extended into the pathway for urging the receiver sheet through the closed loop pathway in the printing direction;

means for sensing when the leading edge of the receiver sheet has passed between the platen and the dye donor web and for producing a signal; and means, responsive to the signal, for disengaging the roller means from the receiver sheet before printing commences.

43. A thermal printer according to claim 42, wherein the means for rotating the platen also rotates the roller means; the roller means is supported on a shaft; and the means for disengaging the roller means comprises:

a radially projecting lobe on one of the rotatable cams; and a cam follower engaging the lobe and the shaft, whereby rotation of the one cam moves the follower and the shaft, thereby moving the roller means into or out of engagement with the receiver sheet.

44. A thermal printer according to claim 43, wherein the means for rotating comprises:

a first pulley mounted for rotation with the platen;

a second pulley mounted for rotation with the shaft and the roller means; and a resilient drive belt engaged with the first and second pulleys to transmit rotation to the roller means and to maintain engagement between the cam and the cam follower.

45. A thermal printer according to claim 44, wherein the platen comprises a central shaft having an end portion; the cam comprises a plate cam mounted for rotation around the end portion; and the means for moving rotates the cam, further comprising a slip clutch between the first pulley and the cam.

46. A thermal printer according to claim 42, wherein the platen comprises a central shaft having an end portion; and the cam comprises a plate cam mounted for rotation around the end portion.

47. A method of thermal printing onto a receiver sheet using a dye donor web comprising successive color groups of patches of different dyes, comprising steps of:

(a) engaging an elongated thermal print head with one side of the dye donor web, an opposite side of the dye donor web with one side of the receiver sheet, and an opposite side of the receiver sheet with a rotatable platen;

(b) rotating the platen in a printing direction to advance both the dye donor web and the receiver sheet;

(c) simultaneously with step (b) operating the print head to transfer to the receiver sheet a dye of a first color of a color group;

(d) following transfer of the dye of the first color, continuing rotation of the platen in the printing direction to advance the receiver sheet from between the platen and the dye donor web;

(e) continuing rotation of the platen in the printing direction to advance the dye donor web a predetermined distance and thereby locate downstream of the printhead a beginning of a next color of the color group and then stopping rotation of the platen;

(f) disengaging the print head from the dye donor web;

(g) recirculating the receiver sheet in the printing direction and reintroducing the sheet between the dye donor web and the platen;

(h) reengaging the print head with the dye donor web;

(i) again rotating the platen in the printing direction to advance both the dye donor web and the receiver sheet; and (j) simultaneously with step (i) operating the print head to transfer to the receiver sheet a dye of the next color of the color group.

48. A method according to claim 47, further comprising a step of:

(k) repeating steps (d) to (j) for successive colors of the color group to complete printing to the receiver sheet.

* * * * *